US005331798A

United States Patent [19]

Ball et al.

[11] Patent Number: 5,331,798

[45] Date of Patent: Jul. 26, 1994

[54] METHOD AND DEVICE FOR JOINING YARN IN AN OPEN-END SPINNING MEANS

[75] Inventors: Anthony Ball, Kipfenberg; Karl Rupert, Ingolstadt; Erwin Braun, Ingolstadt; Ulrich Roediger, Ingolstadt, all of Fed. Rep. of Germany

[73] Assignee: Rieter Ingolstadt Spinnereimaschinenbau AG, Ingolstadt, Fed. Rep. of Germany

[21] Appl. No.: 128,783

[22] Filed: Feb. 11, 1993

Related U.S. Application Data

[63] Continuation of Ser. No. 431,475 filed as PCT/DE89/00275, Apr. 28, 1989, abandoned.

[30] Foreign Application Priority Data

May 3, 1988 [DE] Fed. Rep. of Germany ..... 3814966

[51] Int. Cl.[5] ..... D01H 4/50

[52] U.S. Cl. ..... 57/263; 57/409; 57/93

[58] Field of Search ..... 57/263, 408, 409, 93

[56] References Cited

U.S. PATENT DOCUMENTS

| | | | |
|---|---|---|---|
| 3,728,853 | 4/1973 | Schiltknecht . | |
| 3,842,579 | 10/1974 | Bartling | 57/263 |
| 4,020,621 | 5/1977 | Tsubata | 57/263 |
| 4,047,371 | 9/1977 | Stahlecker | 57/263 |
| 4,059,946 | 11/1977 | Bottcher et al. . | |
| 4,150,530 | 4/1979 | Derichs | 57/263 |
| 4,175,370 | 11/1979 | Stahlecker | 57/263 |
| 4,178,749 | 12/1979 | Stahlecker et al. | 57/263 |
| 4,395,870 | 8/1983 | Neher et al. | 57/263 |
| 4,489,544 | 12/1984 | Morita et al. | 57/263 X |
| 4,497,166 | 2/1985 | Artzt et al. . | |
| 4,633,660 | 1/1987 | Artzt et al. | 57/263 |
| 4,644,742 | 2/1987 | Lovas et al. | 57/263 |
| 4,676,059 | 6/1987 | Artzt et al. | 57/263 |
| 4,712,367 | 12/1987 | Lassmann | 57/263 |

FOREIGN PATENT DOCUMENTS

| | | |
|---|---|---|
| 3516120 | 11/1986 | Fed. Rep. of Germany . |
| 71433 | 4/1984 | Japan . |

*Primary Examiner*—Joseph J. Hail, III

*Attorney, Agent, or Firm*—Dority & Manning

[57] ABSTRACT

A process for piecing a broken yarn on an open-end spinning device in which the fiber feed to the fiber collection surface, and which has been interrupted during stoppage of the open-end spinning device. The fiber feed is switched back on and is immediately brought to full production speed. In this process the combed-out state of the fiber tuft at the point in time of when fiber feed is switched back on is ascertained. The point in time when yarn draw off is switched back on and the speed of it are adapted to when the feeding of fibers to the fiber collection surface becoming effective. The yarn is subjected to a multi-phase acceleration. The first phase of the draw-off acceleration is adapted to the incorporation of fibers into the back-fed yarn end. At least one additional phase of the draw-off acceleration serves to reach and/or to maintain the desired fiber mass. The control device to carry out the piecing process is connected to a device for the ascertainment of the combed-out state of the fiber tuft at the moment of piecing and the control device controls the yarn draw-off as a function of this ascertained combed-out state of the fiber tuft. At least two yarn accelerating devices are provided which can be selected by the control device.

35 Claims, 21 Drawing Sheets

100%
0%
$F_a$
$t_{Fa}$
$t_{Va}$
$t_{Sa}$
$B_F$
F

100%
0%
$F_b$
$t_{Fb}$
$t_{Vb}$
$t_{Sb}$
$B_F$
F

100%
0%
$F_c$
$t_{Fc}$
$t_{Vc}$
$t_{Sc}$
$B_F$
F $t_L$

20
$B_{F2}$
U
$R_F$
$E_G$
$E_G'$
$T_{14}$
$T_{12}$
$B_{F2}$

20
$B_{F2}$
$R_F$
$E_G$
$E_G'$
U
$T_{15}$
$T_{13}$
$B_{F2}$

20
$D_6$
P

20
$B_{F2}$
$R_{Fa}$
$R_{Fb}'$
$R_{Fc}'$
$E_G'$
$A_L$
U
$T_{16}$
$T_{17}$
$T_{18}$
$T_{19}$
$T_{20}$
$T_{21}$
$T_{22}$
$T_{14}$
$T_{15}$
$D_7$
$D_8$
$D_9$

METHOD AND DEVICE FOR JOINING YARN IN AN OPEN-END SPINNING MEANS

This is a continuation of application U.S. Ser. No. 07/431/475 filed as PCT/DE89/00275, Apr. 28, 1989, which was abandoned upon the filing hereof.

BACKGROUND OF THE INVENTION

The instant invention relates to a process to piece in an open-end spinning device in which the feeding of fibers to a collection surface which has been interrupted during the stoppage of the open-end spinning device when the open-end spinning device is switched on again. A yarn end is fed back to the fiber collection surface in synchronization therewith and the fiber feeding to the fiber collection surface, as well as the speed of resumed draw-off of the previously back-fed yarn, is increased to its applicable production value while the fed fibers are incorporated. The instant invention also relates to a device to carry out this process.

It is a known fact that the fiber sliver continues to be combed out by the opener roller after stoppage of fiber feeding (CH-PS 526.646, column 1). Depending on how long the fiber sliver has been stopped before resumption of feeding, different piecing joints result in the yarn.

In order to avoid these disadvantages it has already become known to pivot the fiber tuft out of action range of the opener roller when fiber feeding is interrupted (CH-PS 526.646). This requires, however, a costly design of the feeding device which may lead to malfunctions during the spinning process, while uniform fiber tufts can still not be obtained with certainty, and while damage to the fibers cannot be excluded.

As a remedy it has also been proposed to switch the fiber feeding on and off again before the actual piecing process and to wait for a predetermined period of time before the resumption of fiber feeding (See German Patent No. DE-PS 2,458,042). In addition, the fiber feeding is to be controlled in adaptation to the run-up curve of the spinning rotor. In this manner an always uniform fiber tuft is to be produced in a manner that is always adjustable in the same way in order to improve the quality of the yarn piecing joint and to render it uniform. For this it is, however, necessary to synchronize run-up of the spinning rotor and control of the fiber feeding precisely, as, otherwise, different quantities of fibers remain in the spinning rotor in spite of uniform fiber tufts because of different centrifugal forces in the spinning rotor. The control of fiber feeding in adaptation to the run-up curve of the spinning rotor, furthermore, requires complicated drive and control mechanisms for the fiber feeding. Much time is, furthermore, required for piecing by switching feeding on twice and due to the fact that a predetermined stoppage time must be observed between the switching off and on again.

SUMMARY OF THE INVENTION

It is the object of the instant invention to provide a simple process and a simple device for making it possible to obtain piecing joints of uniform quality in a time-saving manner despite different stoppage times of fiber feeding before a piecing process.

This object is attained through the invention in that the combed-out state of the fiber tuft at the moment when the piecing program is switched on is ascertained. The fiber feeding is switched on and is, at the same time, switched to full production speed and the speed of yarn draw-off is synchronized with the fiber feeding to the fiber collection surface, becoming effective in order to carry out the piecing operation. Contrary to the known processes it is no longer important in the process, according to the invention, that the same states of the fiber tuft be reached. The fiber tuft may indeed show different combed-out states. The piecing program changes according to the combed-out state. Depending on the length of the stoppage time of the fiber feeding, the fiber tuft is combed out and/or depleted more or less heavily, so that the fiber flow increases, accordingly, more or less rapidly when the fiber flow feeding device is switched back on, until finally a section of the fiber sliver that has remained unaffected during the preceding stoppage time is seized by the opener roller of the feeding device and is opened into fibers. This process saves time as it is not necessary to produce a fiber tuft of a given form before the piecing process. Nevertheless piecing joints of constantly uniform strength and aspect are produced as the particular nature of the tuft at the moment of the piecing process is taken into account in the piecing.

The acceleration of yarn draw-off is advantageously controlled as a function of the combed-out state of the fiber tuft in such manner that the yarn draw-off speed is increased more slowly when the tuft has been severely depleted than when it has been only slightly depleted. If the fiber tuft has been only slightly depleted, for example, because a further piecing process was initiated immediately after an unsuccessful piecing attempt, then the fiber tuft exposed by the feeding device to the action of the opener roller is only slightly depleted and is, therefore, again fully ready within a short time. Yarn draw-off is, accordingly, brought very rapidly to the production draw-off speed. If, on the other hand, the fiber tuft is combed out to a greater degree, only a few fibers can, at first, be combed out by the opener device and fed to the spinning device. The flow of fibers, therefore, increases at a correspondingly slower rate. In keeping with this slower increase of the fiber flow, when the fiber tuft has been more severely depleted, the yarn draw-off speed is also increased more slowly, according to the instant invention, so that this adaptation to the state of the fiber tuft achieves a synchronized run-up of fiber feeding and yarn draw-off.

In a further development of this process, it is advantageous for the period of time between the switching on of the fiber feeding and the start of the yarn draw-off is calculated as a function of the depletion of the fiber tuft in such manner that a longer time period is selected for a severe depletion than for a slight depletion. This is because it has been shown that not only the increase of fiber flow is influenced as a function of the depletion of the fiber tuft, but also the point in time when the run-up of fiber feeding begins. For if this depletion was only very slight, as, for instance, in the case of an unsuccessful repair of yarn breakage, the fiber tuft is not only combed out or depleted to a lesser degree. This relatively slightly depleted fiber tuft also still reaches up to the opener roller so that fiber feeding resumes very early. However, the longer the fiber feeding device has been stopped, and the more the stopped fiber tuft has, therefore, also been exposed to the action of the still rotating opener roller, the greater is the depletion of the fiber tuft. The fiber tuft must also continue to be conveyed in the direction of the opener roller, as a function of this greater depletion, before said opener roller is able to open the fiber tuft and the following fiber sliver into individual fibers. Run-up of the fiber feeding starts, accordingly, earlier or later, depending on the degree of tuft depletion. By adapting the time period between switching on of the fiber feeding and the switching on of the yarn draw-off as a function of the depletion of the fiber tuft, an even better quality in piecing joints is achieved.

In the interest of programming simplicity the time period between switching on of the fiber feeding and the beginning of the yarn draw-off is adapted to the combed-out state of the fiber tuft in such a manner that either the fiber feeding is switched on, always within the same period of time of the switching on of the piecing program, independently of the combed-out state of the fiber tuft, and the adjustment of the time period is effected by changing the point in time at which yarn draw-off begins in relation to the point in time when fiber feeding is switched on, or else the yarn draw-off is switched on always within the same time period of switching on the piecing program and the time period is adjusted by changing the point in time at which fiber feeding is switched on in relation to the beginning of yarn draw-off.

The combed-out state of the fiber tuft can be ascertained in different ways. Since the fiber tuft is depleted all the more the longer it is exposed to the action of the opener roller while the feeding device is stopped, provisions are made in an advantageous further development of the process according to the invention for the combed-out state of the fiber tuft to be ascertained on basis of the stoppage time of the fiber sliver while the opener roller continues to run before the fiber feeding to the fiber collection surface is switched on.

In an alternative version of the process, according to the invention, a negative pressure of a predetermined force can be produced on one side of the fiber tuft and the drop in negative pressure can be measured on the other side of the fiber tuft in order to ascertain its combed-out state.

In order to achieve the optimal adaptation of yarn draw-off to the fiber feeding as a function of different degrees of depletion of the fiber tuft, it is advantageous for the yarn to be brought rapidly, possibly in a leap, to production draw-off speed, with a brief delay in relation to the release of the fiber sliver when the fiber tuft has been depleted slightly, to be accelerated in the case of average depletion so that the yarn reaches full production speed, essentially, at the same time as the fiber feeding caused by release of the fiber sliver, with an average increase of the delay over the delay, in the case of a slight depletion, and in the case of severe depletion, to be, at first, greatly accelerated after a delay that is increased over the delay for average depletion until the draw-off speed, in relation to the applicable production values, has reached the same percentage value as the fiber feeding, to be then drawn off with the draw-off acceleration that is such that the further increase the of draw-off speed and the fiber feeding are essentially synchronous.

The start and/or the acceleration of yarn draw-off at piecing up to repair yarn breakage, as a function of the depletion of the fiber tuft, and at piecing in connection with a bobbin replacement is advantageously determined as in case of a severe depletion, whereby the piecing joint produced in the piecing in connection with a bobbin replacement is cut from the following yarn and removed before start of bobbin build-up. While a piecing joint meeting high requirements from the point of view of strength as well as aspect, is produced in the yarn breakage repair where the piecing joint reaches the bobbin. This aspect is unimportant for the piecing joint produced in connection with a bobbin replacement as it does not reaches the bobbin and is removed from the former before the beginning of bobbin build-up. It suffices, therefore, for this piecing joint produced in connection with a bobbin replacement if sufficient strength is ensured, and this leads to a further increase of piecing reliability especially in certain materials, and where very fine yarn is used.

The yarn is, advantageously, subjected to a multiphase draw-off acceleration, with the first phase of the draw-off acceleration being synchronized with the incorporation of the fibers into the back-fed yarn end, and with at least one additional phase of the draw-off acceleration serving to attain and/or to maintain the desired fiber mass in the newly produced yarn. Such a process is of special advantage if the piecing process is adapted to the state of the fiber tuft at the moment of the piecing, but it also leads to improved piecing joints independently of such an adaptation. The piecing joint area is not subjected to an excessive load by the first phase of the draw-off acceleration synchronized with the incorporation of fibers, so that the danger of yarn breakage in this delicate area is reduced significantly. In this coordination of the first phase of the draw-off acceleration with the incorporation of the fibers, the propagation of twist, the centrifugal force of the back-fed yarn, and the newly fed fibers in relation to the strength of the piecing joint, etc., in particular, play an essential role. As soon as the fibers are incorporated into the previously back-fed yarn end, a newly spun yarn segment which is not as sensitive to high yarn tension as the piecing joint follows. Subsequent draw-off can, therefore, be accelerated in such manner that the draw-off and the fiber feeding run as soon as possible in synchronization. The yarn, therefore, attains the desired yarn count very rapidly and the piecing joint is correspondingly short.

It has been found that not only the acceleration of the yarn draw-off plays an important role in order to achieve optimal piecing joints, but also the moment at which the yarn draw-off begins exerts a considerable influence on the quality of the piecing joint. At the same time it was found that, all other conditions being equal, the faster the fiber feeding on the fiber collection increases, the earlier the first phase of she draw-off acceleration must begin.

If the adaptation of the yarn draw-off to the fiber feeding occurs too early, this has an effect in the area of the forming piecing joint and may produce yarn breakage at that location. If, on the other hand, this adaptation comes too late, it takes, accordingly, more time until the yarn has achieved its final fineness. Since the area of the forming piecing joint is especially at risk for breakage, provisions are made in a further advantageous embodiment of the process, according to invention that the first phase of the draw-off acceleration is ended only when the previously back-fed yarn end has once more left the fiber collection surface.

To achieve secure incorporation of the fibers into the back-fed yarn end, the draw-off acceleration of the first phase is adapted to the propagation of the twist to the fiber collection surface in such a manner that the less twist propagation to the fiber collection surface takes place, the lower is the draw-off acceleration of the first phase.

In order to rapidly obtain a yarn with a mass equal to that of a yarn produced under production conditions after incorporation of the fibers into the yarn end, it is advantageous for the yarn draw-off to be strongly accelerated in the additional phase following the first phase of the draw-off acceleration until the yarn draw-off and the fiber flow have attained their same respective percentage values in relation to their production values.

To be able to satisfactorily adapt the yarn draw-off to the rapid increase of fibers with thick yarns, where the fiber flow reaches its full value with extraordinary speed, provisions are made in a further advantageous embodiment of the process for the yarn to be suddenly accelerated up to its production draw-off speed in the second phase of the draw-off acceleration where yarns with high yarn counts are involved.

Such a process is not only advantageous when the fiber sliver has been stopped and high yarn counts are produced. Independently of a measurement of the stoppage time of the fiber sliver, it is advantageous, in a further development of this process, if the fibers are, first of all, prevented from reaching the fiber collection surface after switching on the fiber feeding by deflection and removal, and if the fiber feeding to the fiber collection surface is started up only by reversing this deflection of the fiber flow. In this way the yarn is suddenly brought up to its production draw-off speed in the second phase of the draw-off acceleration after suspension of the deflection of the fiber flow. Here, it may also be advantageous for the first phase of draw-off acceleration to start before suspension of the deflection of the fiber flow, so that yarn draw-off starts even before the first fibers reach the fiber collection surface. In that case the back-fed yarn end need not burst open a fiber ring.

It has been found that it was of special advantage for the multi-phase acceleration of the piecing/draw-off speed, for the newly pieced yarn to be drawn off during the first phase of the draw-off acceleration by the bobbin and, then, during the second phase of the draw-off acceleration by a pair of draw-off rollers driven at production draw-off speed.

When the yarn draw-off speed and the fiber flow reach the same percentage value before reaching their respective production values, it is advantageous to provide for the yarn draw-off acceleration and the feeding rate of the fiber feeding be increased essentially in coordination with their production values. In this manner the maintenance of the desired fiber mass is reached early and is maintained.

The acceleration of the yarn in several phases can be achieved, in principle, by different means. It has been found to be advantageous for the yarn to be exposed from the moment of piecing to the action of a controllable pair of draw-off rollers, drawing off the yarn at the desired draw-off speed. This can be effected by various means. For example, by driving the pair of draw-off rollers with the appropriate acceleration. In machines with a plurality of identical open-end spinning devices this requires, however, that an individually driven pair of draw-off rollers be provided for every spinning device, as only then is it possible to carry out individual piecing at each spinning device without influencing the adjoining spinning devices. To avoid such a costly design it is advantageous for one draw-off roller of the pair of draw-off rollers to be driven continuously at full production draw-off speed, but for this production draw-off speed to be transferred to the yarn only to a controlled degree.

The controlled transfer of the production draw-off speed from the driven draw-off roller to the yarn is advantageously effected in that the slippage between the draw-off rollers and the yarn is changed by controlling the distance between the pair of draw-off rollers. In a further variant of the process according to invention it is, however, also possible to provide for the non-driven draw-off roller of the pair of draw-off rollers to be braked in a controlled manner.

In applying the process according to invention, an excess of yarn which may lead to irregular winding on the bobbin and, therefore, to difficulties in later manufacturing processes is produced between the pair of draw-off rollers and the bobbin with conventional bobbin acceleration. In a further development of the process, according to the invention, provisions are, therefore, made for the yarn to be held under tension between the pair of draw-off rollers and the bobbin. This can be accomplished by also driving the bobbin with greater acceleration during the phase during which the yarn is drawn off with greater acceleration. For this purpose the slippage between the bobbin and its drive is reduced. Alternatively, or in addition, provisions can be made for the bobbin to be subjected to the action of two drives on sides facing each other during this driving phase and/or for the yarn to be stored temporarily between the pair of draw-off rollers and the bobbin to stretch the yarn supplied by the pair of draw-off rollers.

Optimal piecing joints with respect to strength and aspect are achieved, according to the invention, in that yarn draw-off begins even before the fiber ring has once again attained its desired thickness after switching on fiber feeding, in that the yarn is at first drawn off from the fiber collection surface with so little acceleration that the thickness of the fiber ring increases, but has not yet exceeded the desired thickness by the point in time when the previously back-fed yarn end has again left the fiber collection surface and in that yarn draw-off, once the yarn end has left the fiber collection surface, is now accelerated so rapidly that the speed of yarn draw-off and fiber feeding attain the same percentage value, in relation to their production values, at the latest, when a yarn length equal to the circumference of the spinning rotor has been drawn off from the fiber collection surface and, then, maintain their synchronous relationship.

The number of turns of twist in the completed yarn depends on the relationship between the rotational speed of the spinning elements and the yarn draw-off speed. In order to avoid, in a simple manner, an excessive deviation of the twist in the piecing joint and in the following yarn segment from the remainder of the yarn, the design of the spinning element as a spinning rotor can be such that to carry out piecing the spinning rotor is first brought to a rotational speed lying below its production speed, the yarn is then fed back to the fiber collection surface at this rotational speed, is combined with fibers at that location, and is then subjected to a multi-phase draw-off acceleration while the spinning rotor is, at the same time, accelerated to its production speed. Without necessitating a regulation of the rotational speed of the spinning rotor an adaptation of the rotor speed to the lower yarn draw-off speed is thus achieved. Depending on the piecing process selected, the fibers can enter the rotor even before the yarn end is fed back to the fiber collection surface. When a device is used in which the fibers are at first prevented from entering the rotor when fiber feeding has been switched on, and in which the full fiber flow enters the rotor suddenly as a result of change-over of the fiber flow, provisions are also made for the yarn end to be first fed back into the rotor and for the fiber flow into the rotor to be resumed only then.

To enable the twist in the section of yarn following the piecing joint to adapt extensively to the yarn twist in the remainder of the yarn without necessitating regulation for this, in an advantageous design of the process according to invention, the spinning rotor is accelerated from a rotational speed below its production speed to full production speed at such moment and in such a manner that it reaches that speed essentially at the moment when the yarn also reaches its production draw-off speed.

According to the instant invention, optimal piecing joints are obtained through the fact that after the first draw-off acceleration phase the yarn goes through one or two additional phases of draw-off acceleration as a function of the time required for the increase of the fiber feeding to its full production value in such a manner that the yarn is suddenly brought to its production draw-off speed in a second phase when the fiber flow increases rapidly, that the yarn is accelerated in a second phase so that it reaches its full production value essentially at the same time as the fiber flow in the case of the average increase of the fiber flow, and that the yarn is at first greatly accelerated in a second phase of the draw-off acceleration in the case of a slow increase of fiber flow, until the draw-off speed, in relation to the applicable production values, has attained the same percentage value as the fiber flow, to be then drawn off in a third phase with such draw-off acceleration that the second increases of the draw-off speed and of the fiber flow are substantially synchronized.

To obtain especially unobtrusive piecing joints, the yarn end to be fed back is subjected to pretreatment before being fed back to the spinning element so that the yarn end is given a basically wedge-shaped configuration.

In a device for piecing in an open-end spinning device equipped with a fiber collection surface, a fiber feeding device, a draw-off device for the yarn as well as a control device to control the piecing process, provisions are made according to the invention to carry out the process that the control device be connected to a device which ascertains the combed-out state of the fiber tuft at the moment of piecing and controls the yarn draw-off as a function of this combed-out state.

This device for the determination of the state of the fiber tuft is designed in different ways. It may, for example, be made in form of a computer to which the yarn monitor, on the one hand, and the control device controlling the piecing process, on the other hand can be connected for control purposes.

It is advantageous not to provide a computer for each spinning station or for each piecing device, but it is sufficient for this computer to be assigned, at least, to one spinning machine. If necessary, such a computer can, however, also be assigned jointly to several spinning machines.

In order to achieve an adaptation of the yarn draw-off to the fiber feeding on the collection surface of the spinning element, which has been, more or less, affected by the combed-out state of the fiber tuft, provisions are made in an advantageous embodiment of the object of the invention for the control device to be equipped with a time control unit to set the time period between switching on the fiber feeding to the fiber collection surface and the beginning of the yarn draw-off.

The device for the determination of the combed-out state of the fiber tuft can also be made in the form of a surface supporting the fiber tuft, with an orifice to which a manometer is connected. This orifice is advantageously located in the feeding tray. It may be advantageous to cover this orifice with a sieve which retains the fiber tuft in order to prevent the tuft from getting into the orifice.

So that the fibers fed to the spinning element may be incorporated in the best manner possible into the back-fed yarn end, on the one hand, and so as to create the conditions for the piecing joint to be kept as short as possible, on the other hand, at least two yarn accelerating devices which can be selected by the control device are advantageously provided. The first accelerating device serves to accelerate yarn draw-off in adaptation to the incorporation of fibers into the back-fed yarn end, while the other (at least one) yarn accelerating device serves to bring the yarn to the desired yarn mass and/or to maintain it at this yarn mass. Such a device is advantageous in connection with a device in which the acceleration attitude of the yarn draw-off is controlled as a function of the condition of the fiber tuft at the moment of piecing as well as independently thereof.

In an advantageous embodiment of the invention the first yarn accelerating device is made in the form of a driving device capable of being driven at controlled speed for a bobbin in the winding device, while the second yarn accelerating device is made in the form of a pair of draw-off rollers driven at the production draw-off speed.

When the second yarn accelerating device is constituted by the normal draw-off device it is advantageous for the latter device to consist of a pair of draw-off rollers with a first draw-off roller capable of being driven at production draw-off speed and a second draw-off roller which can be lifted off the driven draw-off roller and for the control device through which the second yarn accelerating device can be actuated to be connected for control to a lifting device of the second draw-off roller. As long as the second draw-off roller is lifted off the driven draw-off roller it does not exert any draw-off action on the yarn, so that the yarn is drawn off from the spinning element only by the correspondingly driven bobbin. Instead of a draw-off roller capable of being lifted off or, in addition to this device, it is also possible to provide for the control device to be connected for control to an insertion device to insert the yarn into the nip of the pair of draw-off rollers.

In an alternative embodiment, a drive to control the speed of the pair of draw-off rollers can be provided instead of several accelerating devices. This alternative embodiment of the invention can also be used in combination with, or independently from, a device in which the acceleration attitude of the yarn draw-off is controlled as a function of the state of the fiber tuft.

Yet another alternative embodiment of the invention which can also be used in combination with or independently from a device in which the acceleration attitude is controlled as a function of the state of the fiber tuft at the moment of piecing provides for the pair of draw-off rollers to be equipped with a first draw-off roller capable of being driven at the production draw-off speed and with a second draw-off roller capable of being driven by this first draw-off roller, and for the draw-off attitude of the pair of draw-off rollers to be altered by the control device. To effect this change of the pair of draw-off rollers, the pair of draw-off rollers is preferably assigned a lifting device for the second draw-off roller to change the slippage between the two draw-off rollers or alternatively a braking device capable of being controlled which can be brought to act upon the second draw-off roller.

If a device is provided to selectively remove fibers before they reach the fiber collection surface or to feed the fibers to the fiber collection surface, the object of the invention is advantageously designed so that the control device is connected, for control, to the device for the selective removal or feeding of the fibers. In this way the yarn draw-off can be easily adapted to fiber flow.

For the passage from one phase of the draw-off acceleration to the next, provisions are made for the control device to contain a time control device, whereby the latter can be switched on as the first phase of draw-off acceleration is initiated. In order to be able to easily adapt the transitions between the phases of draw-off speed to the applicable conditions, the time control device can be equipped with a setting device. In this way it is possible to ensure, for example, that the next acceleration phase of yarn draw-off will only start when the yarn end has left the fiber collection surface and when the danger of yarn breakage is thus considerably reduced.

To be able to adapt the rotor speed and the yarn draw-off speed extensively to each other it has been shown to be advantageous for the open-end spinning element to be assigned a drive with a change-over device in order to drive the open-end spinning element selectively at one of two predetermined speeds, where the change-over device is connected to the control device controlling the draw-off acceleration in order to also bring the open-end spinning element to its higher speed as a function of the change-over from the first phase of the draw-off acceleration to the following, greater, draw-off acceleration.

In order to be able to accelerate the bobbin especially rapidly it is important to eliminate the slippage as much as possible. For this purpose the winding device is equipped with a continuously driven driving device and for a device for increasing contact pressure between a bobbin located in the winding device and the continuously driven driving device to be provided, and to be connected to the control device for the control of draw-off acceleration. This device to increase the contact pressure is preferably equipped with a pressure roller which can be brought to bear against the roller on the side away from the continuously driven driving device. In order to save an additional component for the speed control of the bobbin and, thus, to be able to design the device in a compact manner, the pressure roller is capable of being driven at a controllable speed in a preferred embodiment of the device according to the invention.

To avoid having to provide a separate control device for each spinning device in spinning machines with a plurality of adjoining, identical spinning devices, provisions are made in an embodiment with a service unit capable of traveling alongside the spinning stations for the control device to be located on the service unit.

It is also possible to provide a program memory for the simultaneous storage of several different piecing programs which can be selected in accordance with different spinning conditions. Thus, for example, a bobbin replacement device can be connected, for control, to the program memory in which a program can be established which can be selected to carry out the piecing process in combination with a bobbin replacement.

The device is simple in its design and, in the preferred embodiment, is constituted by components which are, as a rule, provided in open-end spinning devices, but which allow for better piecing, and which can be adapted to the applicable conditions thanks to the novel controls of the invention. The device according to the instant invention can, therefore, be added on without great difficulties to existing open-end spinning devices. For the control, it suffices to replace a few index plates, control cams or chips. It is, therefore, possible to optimize the piecing process with simple means and with great piecing security, whereby short and very unobtrusive piecing joints of high quality can be attained through the process according to the invention.

BRIEF DESCRIPTION OF THE DRAWINGS

Examples of embodiments of the invention are explained hereinafter through the drawings, in which.

DETAILED DESCRIPTION OF THE INVENTION

Figure 4:
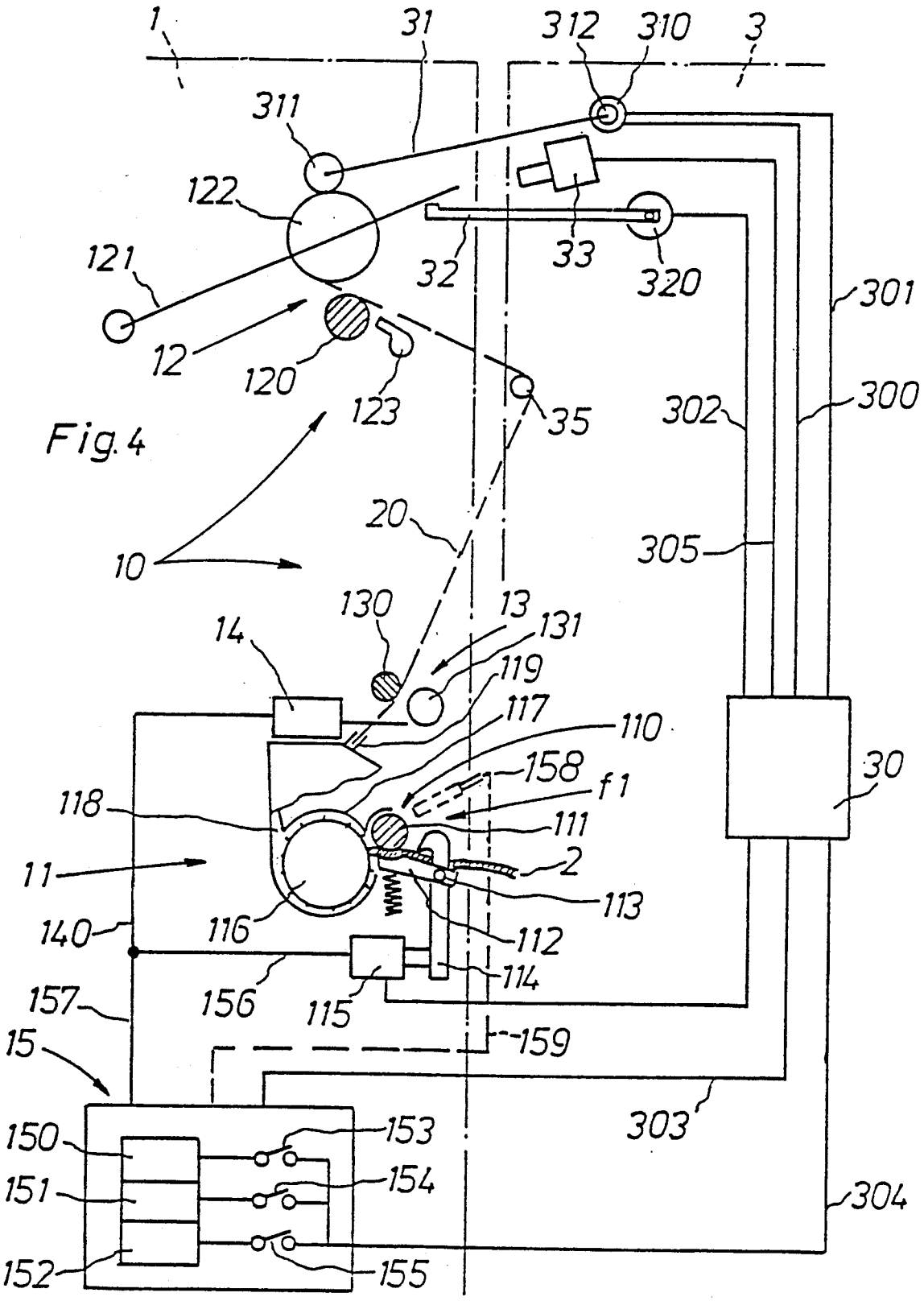
FIG. 4 is a schematic side view of an open-end spinning station and a traveling service unit to control the piecing process.

The device to carry out the process shall first be described through FIG. 4 to the extent necessary to explain the problem solved by the invention.

FIG. 4 shows, in its left half, a schematic representation of a spinning station 10 of an open-end spinning machine 1. Each spinning station 10 is provided with an open-end spinning device 11 as well as with a winding device 12.

Each open-end spinning device 11 is equipped with a fiber feeding or delivery device 110 as well as with an opener device 116. The fiber feeding or delivery device 110, in the embodiment shown, consists of a feeding roller 111 with which a feeding tray 112 interacts. The feeding tray 112 is mounted so as to be capable of pivoting on a axle 113 which, furthermore, supports a clamping lever 114 made in form of a guide element for a fiber sliver 2 and which can be brought to bear against the feeding tray 112 or be lifted away from it again by means of a solenoid 115.

The opener device 116, in the embodiment shown in FIG. 4, is essentially made in form of an opener roller located in a housing 117. From housing 117 a fiber feeding channel 118 extends to a spinning element (not shown in FIG. 4) e.g. in the form of a spinning rotor 16 (FIG. 28) or of a friction roller 18 (FIG. 31)] from which the spun yarn 20 is drawn off through a yarn draw-off pipe 119.

During the undisturbed spinning process a pair of draw-off rollers 13 with a draw-off roller 130 is driven at production speed and draw-off roller 131 is elastically pressed against the driven draw-off roller 130 for the yarn 20. On its way between open-end spinning device 11 and the pair of draw-off rollers 13, the yarn 20 is monitored by a yarn monitor 14.

The yarn 20 then reaches the winding device 12 which is, furthermore, equipped with a driven winding roller 120. The winding device 12 is furthermore equipped with a pair of pivotable bobbin arms 121 which hold a bobbin 122 rotatably between them. The bobbin 122 lies on the winding roller 120 during the undisturbed spinning process and is, therefore, driven by it. The yarn 20 to be wound up on bobbin 122 is inserted into a traverse yarn guide 123 which is moved back and forth alongside bobbin 122 and thus ensures the even distribution of the yarn 20 on the bobbin 122.

The yarn monitor 14 and the solenoid 115 are connected via circuits 140 or 156,157 for control to a computer or control device 15, having a program memory in which several programs 150,151, 153, . . . are stored. These programs can be selected to switch on the fiber feeding device 110 in connection with piecing by means of the switches 153,154, 155,...(which may be of electronic design) as a function of the period of time between the actuation of the yarn monitor 14 due to the occurrence of a yarn breakage and the actuation of the solenoids and, possibly of other spinning conditions such as specific material, yarn thickness, etc.

A service unit 3, equipped with a control device 30 which is connected for control of the piecing process to the computer or control device 15, is capable of traveling alongside the open-end spinning machine. The control device 30 is, furthermore, connected to the pivot drive 310 of a swivel arm 31 which bears an auxiliary drive roller 311 at its free end. The auxiliary drive roller 311 is driven by a drive motor 312 which is also connected to the control device 30 for control purposes.

Pivot arms 32 can be brought towards the bobbin arms 121, and arms 32 are also mounted pivotably on the service unit 3, their pivot drive 320 is connected for control purposes to the control device 30.

The above-mentioned elements of the service unit 3 are connected for control purposes to the control device 30, i.e. pivot drive 310 via circuit 300, drive motor 312 via circuit 301 and pivot drive 320 via circuit 302. The control device 30 of the service unit 3 is, furthermore, connected for control purposes via circuits 303 and 304 to the control device 15 on the machine side.

Figure 1A:
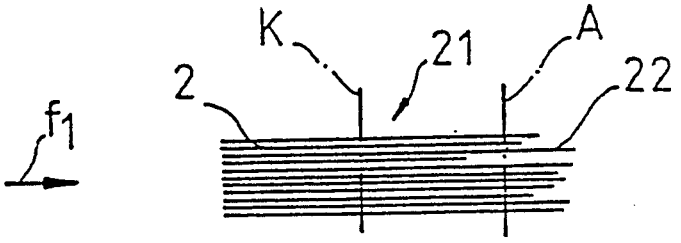
FIG. 1*a*–1*c* are schematic drawing of a fiber tuft which has been subjected to the action of an opener device for different periods of time after stoppage of the fiber sliver.

Before giving an explanation in further detail of the operation of the device of FIG. 4, described through its components, it shall be first explained through FIGS. 1*a*) to *c*) how the stoppage times of the different lengths of the feeding device 110 affects the advancing end of the fiber sliver 2, i.e. the fiber tuft 21, while the opener device 116 continues to run.

FIGS. 1*a*) to *c*) show the nip K in which the fiber sliver 2 is clampingly held when the fiber feeding device 110 is stopped.

In the device shown in FIG. 4 the feeding roller 111 is not controlled to stop feeding the fiber sliver 2. Instead the clamping lever 114 is pivoted so that its upper end is brought to bear against the feeding tray 112, with the fiber sliver 2 being clamped between clamping lever 114 and feeding tray 112 and the feeding tray 112 is pivoted away from the feeding roller 111. The nip K is constituted by the line at which the clamping lever 114 presses the fiber sliver 2 against the feeding tray 112.

Alternatively, however, the solenoid 115 and the clamping lever 114 can be omitted and, instead, a coupling (not shown) can be assigned to the feeding roller 111. In that case the nip K is constituted by the line in which the feeding tray 112 presses the fiber sliver 2 against the feeding roller 111.

FIGS. 1*a*) to *c*), furthermore, show line A which symbolizes the limit of the operating range of the opener device 116 (see also FIG. 4).

During the normal spinning process, during which the feeding device 110 and the opener device 116 (e.g. the opener roller) are running, the opener device 116 acts (in FIGS. 1*a*) to *c*) from the right) upon the fiber tuft 21 up to the line A and combs fibers 22 out of it, these fibers are then fed through the fiber feeding channel 118 to the spinning element (not shown). As FIG. 1*a*) shows, the fibers 22 extend, in part, far beyond line A into the operating range of the opener device 116, while other fibers 22 extend only into the area between nip K and line A.

The fiber tuft 21 is of similar aspect if the feeding device 110 is stopped briefly.

Figure 1B:
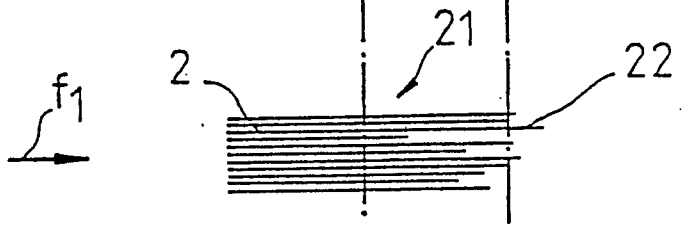

If the feeding device 110 is stopped for a longer period of time while the opener device 116 continues to run, the latter combs additional fibers 22 out of the fiber tuft 21. The fiber tuft 21 has then only few fibers 22 left which reach beyond line A (FIG. 1*b*)). The longer the stoppage of the feeding device 110 (always with the opener device 116 continuing to run), the shorter the fiber tuft 21 becomes, until no more fibers 22 extend into the operating range of the opener device 116 in the case of long stoppage, i.e. until the longest fibers 22 reach from the nip K at the most up to line A (FIG. 1*e*)).

Figures 2A, 2B, 2C:
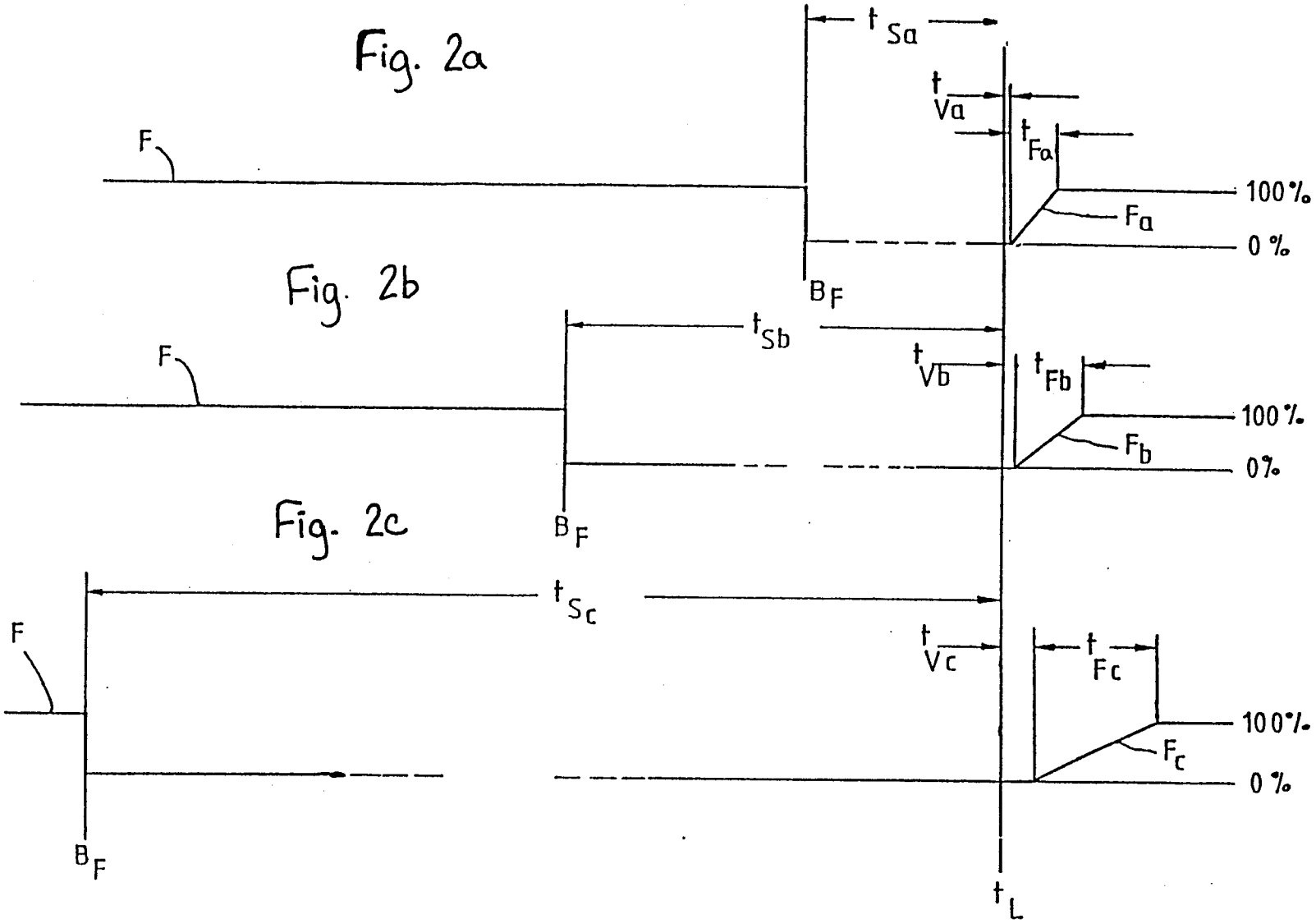
FIG. 2*a*–2*c* are is a schematic comparison of the influence of different stoppage times of the fiber sliver upon the onset start of fiber feed.

As is explained in further detail through FIG. 2, a correspondingly different run-up behavior of fiber feeding results from these different states of the fiber tuft 21. FIG. 2 shows the time t on the abscissa, while the ordinate indicates the speed in percentages (%). In FIGS. 2*a*) to 2*c*) different stoppage times $t_{Sa}$, $t_{Sb}$ and $t_{Sc}$ are shown, beginning with the occurrence of a yarn break $B_F$ and ending through switching back on the feeding device 110.

Figure 1C:
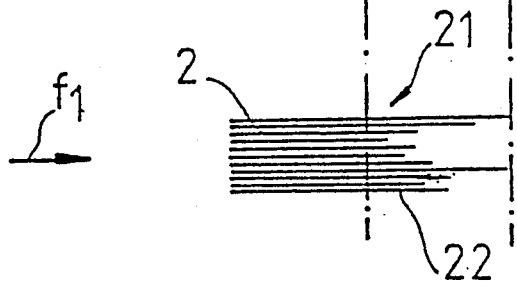

When the feeding device 110 is started up again at a point in time $t_L$ after a stoppage period (FIG. 2), the fiber sliver 2 is conveyed in the direction of arrow $f_1$ (FIG. 1) and is brought to the opener device 116. During a very brief stoppage time $t_{Sa}$ (FIG. 2) of the feeding device 110 (see FIG. 1*a*)) the fiber tuft 21 has practically the same shape as during the spinning process itself. With a minimal delay $t_{Va}$, necessitated by the time required to produce again a fiber stream between feeding device 110 and the open-end spinning element, the fiber feeding, i.e. the fiber stream having arrived on the not-shown fiber collection surface of the open-end spinning element, again reaches its full value (100%—see run-up time $t_{Fa}$). This is shown in FIG. 2*a*) where the fiber supply F is represented in form of a thick, solid line.

If the stoppage time $t_{Sb}$ was somewhat longer (FIG. 2*b*), a depleted fiber tuft 21 is now within the operating range of the opener device 116. Thus, only a somewhat thin fiber stream reaches the fiber collection surface at first, following start-up of the feeding device 110, whereby this fiber flow starts also after a delay $t_{Vb}$ which is somewhat longer than that for the fiber flow according to FIG. 2*a*). Even if an ever increasing amount of fibers 22 come within the operating range of the opener device 116 during the subsequent conveying of the fiber sliver in the direction of arrow $f_1$ (FIG. 1), the fiber feeding, nevertheless, does not suddenly increase to its full value (100%) but requires a certain amount of time for this. The run-up time $t_{Fb}$ for a fiber tuft 21 according to FIG. 1*b*) is therefore longer than with a fiber tuft 21 according to FIG. 1*a*).

The situation becomes even more extreme with a fiber tuft 21 which has been subjected for a very long period of time to the action of the opener device 116 with the feeding device 110 stopped. In case of a long stoppage time $t_{Sc}$, the fiber tuft 21 must first be brought in the direction of arrow $f_1$ to beyond line A and within the operating or acting range of the opener device 116. Since the fiber tuft 21, according to FIG. 1*c*), has been combed out considerably more than the fiber tuft 21 according to FIG. 1*b*), it also takes longer until the fiber flow starts (see delay $t_{Vc}$). The run-up time $t_{Fc}$ is also considerably longer.

FIG. 2 shows (very schematically) the natural run-up curve of the fiber feeding such as it occurs in the spinning element. This run-up curve is produced upon switching on the feeding device 110, if nothing has interfered, from the outside, with the drive of the feeding device 110 but if the latter is merely being connected to a drive running at the production speed by being switched on, or if the feeding device 110, running at the production speed is again brought into action or if this drive, although not stopped before, has merely been taken out of action by lifting off the feeding tray 112 from the feeding roller 111. This natural run-up curve forms as a function of the combed-out state and, therefore, varies accordingly.

Figure 32:
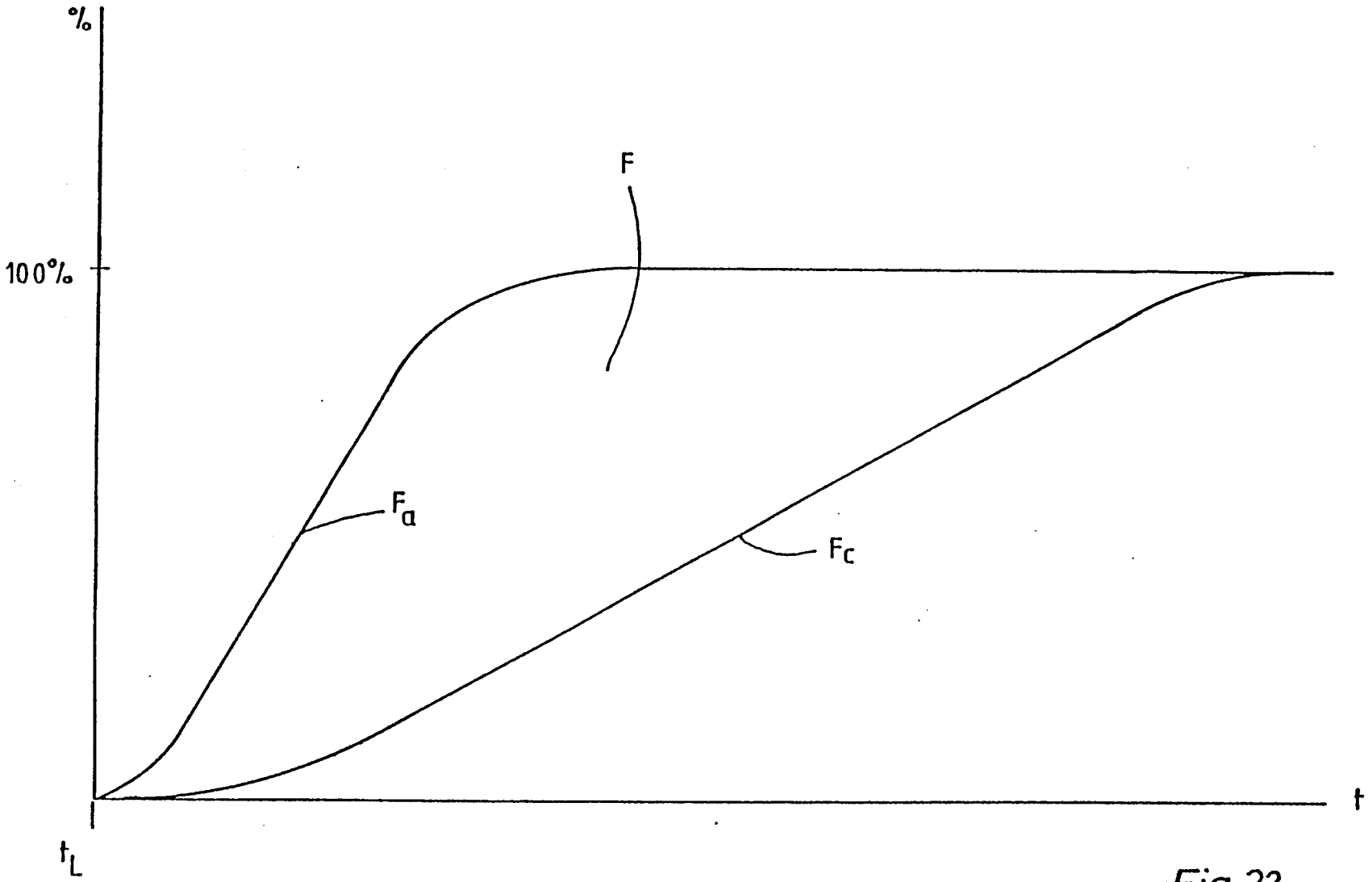
FIG. 32 is a diagram of the run-up curve of the feeding for different combed-out states of the fiber tuft.

FIG. 32 shows the fiber feeding F in the form of a surface surrounded by a hysteresis curve. The hysteresis curve is constituted by lines representing extreme fiber supplies. A line embodying this fiber supply Fa is produced if the fiber tuft 21 has been combed out by the opener device 116 only briefly while the feeding device 110 is stopped. The other line embodies fiber supply $F_c$ such as it is produced if the stopped fiber tuft 21 is subjected for a long period of time to the combing-out effect of the opener device 116.

As can clearly be seen, the fiber supply F takes effect more rapidly or more slowly depending (as mentioned earlier) on the duration of the combing-out effect.

Such a hysteresis curve depends on certain predetermined conditions and different combing-out periods. If other parameters, such as, for example, the fiber sliver feeding speed, the material, etc. are altered, the hysteresis curve changes accordingly in that the fiber supplies $F_a$ and Fc for example, are closer to each other or further apart and, in that these fiber supplies $F_a$ and $F_c$ may have characteristic lines of different steepness.

Figure 5:
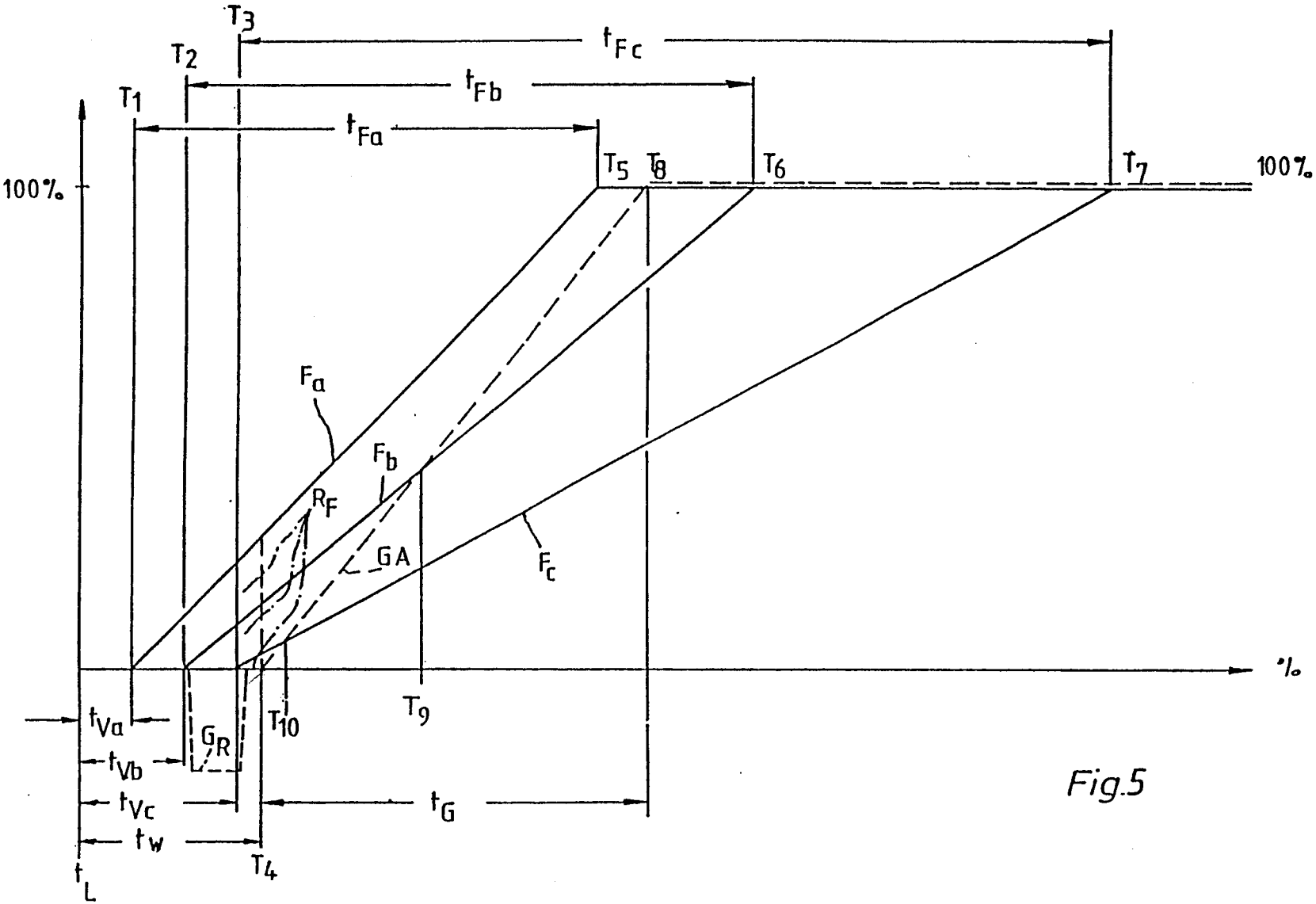
FIG. 5 is a schematic view which shows start-up diagrams of the fiber feeding and the fiber draw-off as a function of different stoppage times of the spinning device.

FIG. 5 shows the different types of run-up attitudes of the fiber flow, and, here too, (as in FIG. 32) only the time following point in time $t_L$ (see FIG. 2) is indicated. FIG. 5 also shows the yarn back-feeding $G_R$ and the yarn draw-off $G_A$ which are normally pre-set. As can be seen from this drawing, completely different conditions result for piecing. The reason for this is explained below:

In FIGS. 2 and 5 (and also in FIG. 13, 20 and 25) the lines for the fiber supply F and the fiber draw-off $G_A$ are represented merely in the form of straight lines. The transitions at the beginning and at the end of the acceleration curves have been neglected in this basic sketch for the sake of simplification.

This problem is clarified by the example of an embodiment shown in FIG. 5. FIG. 5 contains in scaled representation the points in time $T_1$, $T_2$ and $T_3$ at which the fiber flow substantially starts in the spinning element under the conditions selected for the example, while the points in time $T_5$, $T_6$ and $T_7$ indicate when the full fiber flow going into the spinning element has been substantially attained. The points in time $T_4$ and $T_8$ mark the beginning and the end of the fiber draw-off acceleration.

With a stoppage time $t_{Sa}$ of the feeding device 110 of 30 seconds for example, with a certain material and under given conditions (which are unimportant here for the explanation of the principle) a delay $t_{Va}$ before the start of the fiber flow $F_a$ (see FIGS. 2 and 5) of 0.1 seconds results. The run-up curve $t_{Fa}$ is 0.9 seconds, so that 1 second passes from the moment at which the feeding device 110 is switched back on until the full fiber flow $F_a$ is reached. Yarn draw-off $G_A$ starts at preset 0.35 seconds after the feeding device 110 has been switched back on and reaches its production speed after 1.1 seconds. Since yarn draw-off $G_A$ and fiber flow $F_a$ do not run synchronously, a fiber excess forms, leading to a thick spot in the yarn 20. This thick spot can be seen from the quadrangle $T_1$, $T_4$, $T_8$, $T_5$ because the line representing yarn draw-off $G_A$ is always on the right of the line representing the fiber flow $F_a$, i.e.1 because the yarn draw-off $G_A$ always follows the fiber flow $F_a$.

With a stoppage time $t_{Sb}$ of approximately 2 minutes of the feeding device 110 and, therefore, also of the fiber tuft 21 while the opener device 116 continues to run, a fiber feeding $F_b$ results in the spinning element, starting with a delay $t_{Vb}$ of 0.2 seconds after the point in time when the feeding device 110 is switched back on, the fiber feeding $F_b$ reaching its full production value (100%) after another 1.1 seconds. With the same yarn draw-off $G_A$ and at the point in time $T_g$ when fiber feeding $F_b$ and fiber draw-off $G_A$ have the same percentage value, an excess of material results which is characterized by the triangle $T_2$, $T_4$, $T_9$ and which leads to a thick spot in the yarn 20. As of the point in time $T_9$ on the other hand, and until point in time $T_6$, a thin spot as shown by the triangle $T_9$, $T_6$, $T_8$ is produced in the yarn 20.

With a very long stoppage time of five, ten or more minutes, the fiber tuft has been depleted even more severely. In the example shown it only takes about 0.3 seconds ($T_3$) until the fiber feeding $F_c$ takes effect in the spinning element. The run-up of fiber feeding $F_c$ also lasts somewhat longer now, i.e. 1.7 seconds ($T_7$). Since yarn draw-off $G_A$ starts already at the point in time $T_4$, i.e. 0.35 seconds after the feeding device 110 is switched back on and thereby 0.05 seconds after the start of effectiveness of the fiber feeding $F_c$ only a very small fiber ring $R_F$ is able to accumulate. Yarn draw-off $G_A$ is accelerated very rapidly so that the fiber ring $R_F$ becomes thinner and thinner. Under these circumstances piecing is only possible with great difficulty, if at all. As a rule the piecing process will fail or the yarn will subsequently tear.

In FIG. 2 the stoppage time $t_{Sa}$, $t_{Sb}$, and $t_{Sc}$ has been represented for the sake of simplification as a time period between yarn breakage $B_F$ and the point in time $t_c$ when the feeding device 110 is started up again.

As is shown more precisely in FIG. 3, the stoppage time $T_{Sa}$, $T_{Sb}$, and $t_{Sc}$ is however, actually the time period between yarn breakage $B_F$ and the point in time $t_E$ when the piecing device which is located on the service unit 3 in the embodiment of FIG. 4 is switched on.

Figures 3A, 3B:
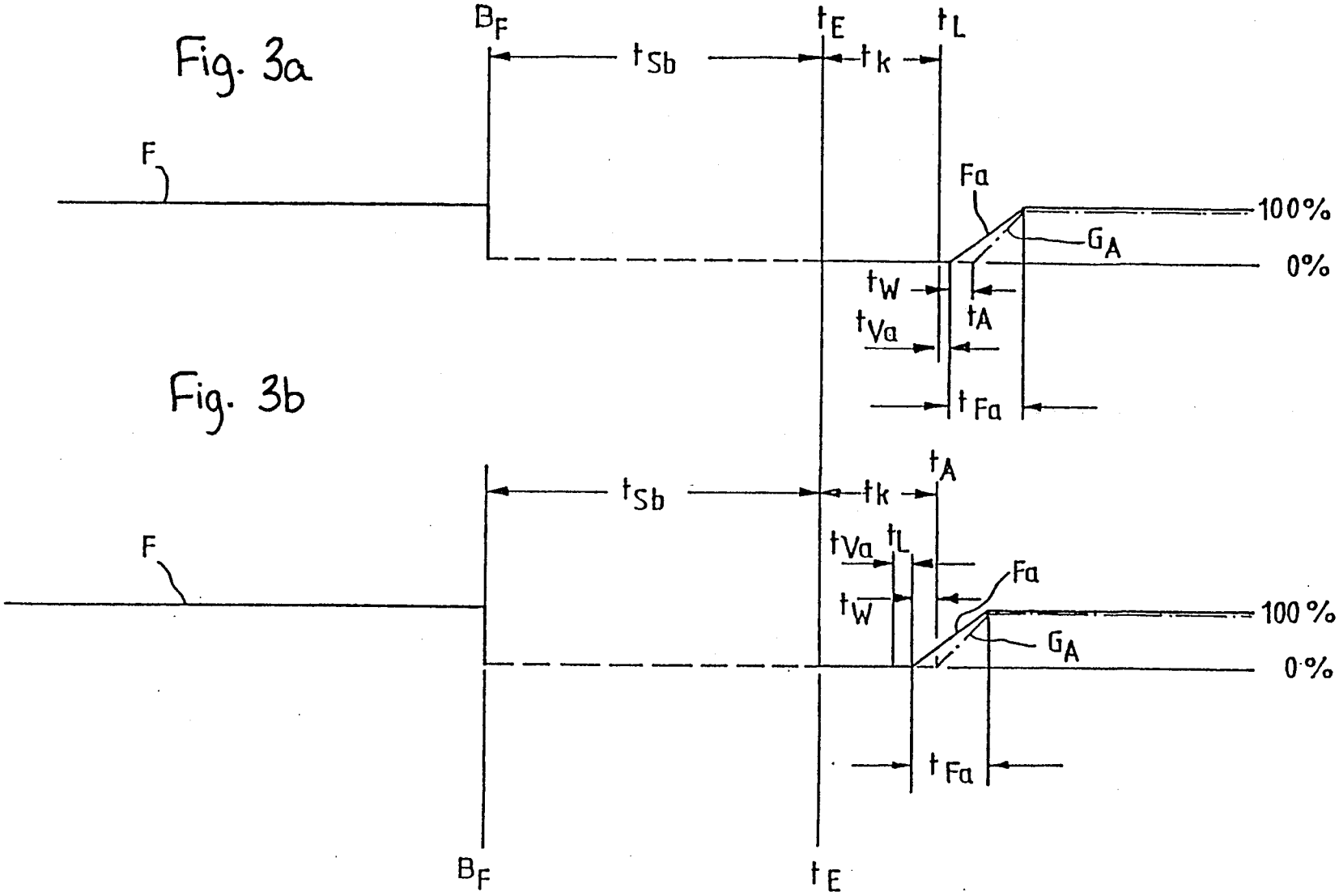
FIG. 3*a* and 3*b* are schematic representations of two variants of the control of the fiber feeding and the yarn draw-off as a function of the stoppage time of the fiber sliver.

According to FIG. 3*a*) the feeding device 110 is switched on after a predetermined time interval $t_K$ following the switch-on moment $t_E$, whereupon, fiber feeding $F_a$, $F_b$, or $F_c$ takes effect in the spinning element itself after a delay $t_{Va}$, $t_{Vb}$, or $t_{Vc}$. After a waiting period $t_W$, which is calculated as a function of the duration of stoppage $t_{Sa}$, $t_{Sb}$, or $t_{Sc}$, at the point in time $t_A$, yarn draw-off $G_A$ is switched on and runs up in a manner to be described below in further detail, reaching its full production value (100%) substantially at the same time as the fiber feeding $F_a$, $F_b$, or $F_c$.

FIG. 3*b*) shows an alternative to the above-described process. The stoppage time $t_{Sa}$, $t_{Sb}$, or $t_{Sc}$ is again measured (see FIG. 2). The point in time $t_E$ for switching on, and through the constant time interval $t_K$, the point in time $t_A$ at which yarn draw-off $G_A$ begins is already determined. A computer determines the point in time $t_L$ at which the feeding device 110 is to be switched on as a function of the stoppage time $t_{Sa}$, $t_{Sb}$, or $t_{Sc}$, by appropriate determination of the waiting period $t_W$ and/or of the length of the expected delay $t_{Va}$. This determination is made at extreme speed within the time span given by the time constant (time interval $t_K$) and early enough so that the desired time sequence is ensured.

The time interval $t_K$ is relatively long, as all the preparations required for piecing take place during that period. As a rule these are the cleaning of the spinning element, as well as the search for, preparation, and back-feeding of the yarn end with all the auxiliary activities connected therewith. These are not represented in FIG. 3 for the sake of simplicity.

Figure 6:
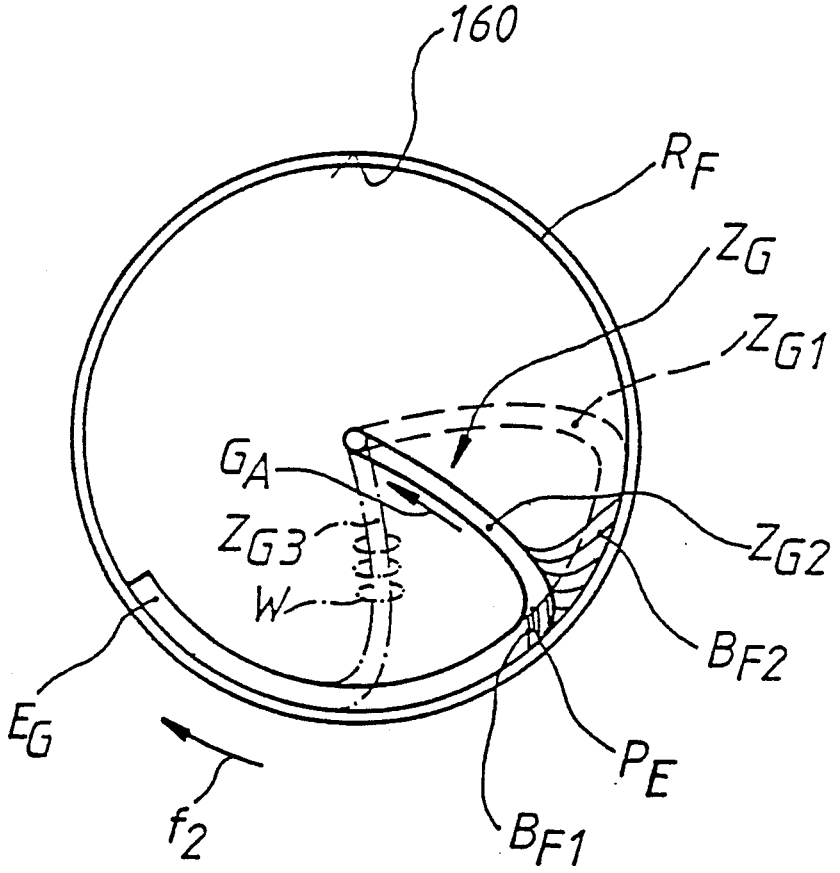
FIG. 6 is a schematic view which shows the fiber collection surface of a spinning rotor with a fiber ring, and a yarn end deposited on this fiber ring during the piecing phase.

Before describing the piecing joint which is produced with the different run-up curves of fiber feeding ($F_a$, $F_b$, $F_c$) in further detail, events occurring at the breaking up of the fiber ring $R_F$ shall be described. This shall be done by taking the example of the fiber collection surface 160 (FIG. 6) of a spinning element made in the form of a spinning rotor.

The time difference ($T_4-T_1$) or ($T_4-T_2$) or ($T_4-T_3$) shows how much later than fiber feeding F the fiber draw-off $G_A$ begins. The greater the time difference, the larger is the fiber ring $R_F$ forming in the spinning rotor 16, and the fiber ring decreases in size, in proportion with a decrease of this time difference. This can clearly be seen from FIG. 5.

It is assumed that a yarn breakage is to be repaired. Following the usual preparatory steps (cleaning of the spinning rotor 16, (FIG. 27) search for the yarn end $E_G$ on the bobbin 122 (FIG. 4), cutting and preparation of the yarn end, start-up of the previously stopped spinning rotor 16, etc.) fiber feeding $F_a$, $F_b$ or $F_c$ (period in time $T_1$, $T_2$ or $T_3$) is initiated and now runs up to its production value (100%) and forms a fiber ring $R_F$ in the spinning rotor 16. At a given point in time $T_4$ the yarn end $E_G$ is fed back to the fiber collection surface 160 (FIG. 6) of the spinning rotor 16 (yarn back-feeding $G_R$), whereby the yarn end $E_G$ is deposited over a portion of the circumference of the fiber collection surface 160, and its radial intermediate zone $Z_G$ assumes the position $Z_{G1}$.

After a brief sojourn $t_Z$ on the fiber collection surface 160 the yarn end $E_G$ is subjected to a yarn draw-off $G_A$ which also runs up to its production speed value (100%). At the same time, the yarn end $E_G$ is stretched and, with its intermediate zone $Z_G$, reaches position $Z_{G2}$. At the same time the yarn end $E_G$ pulls on the fiber ring $R_F$ so that, as seen in the circumferential sense of the fiber collection surface 160, fibers extend on both sides of the point of incorporation $P_E$ from the yarn end $E_G$ to the fiber ring $R_F$ and constitute fiber bridges $B_{F1}$ and $B_{F2}$. The fiber bridges $B_{F1}$ and $B_{F2}$ tear and wrap themselves in the form of wild windings W around the yarn end $E_G$. The size of the fiber bridge $B_{F2}$ and thereby the size of the accumulation of windings W depends substantially on the rotor diameter and on the length of the processed fibers.

Figure 33:
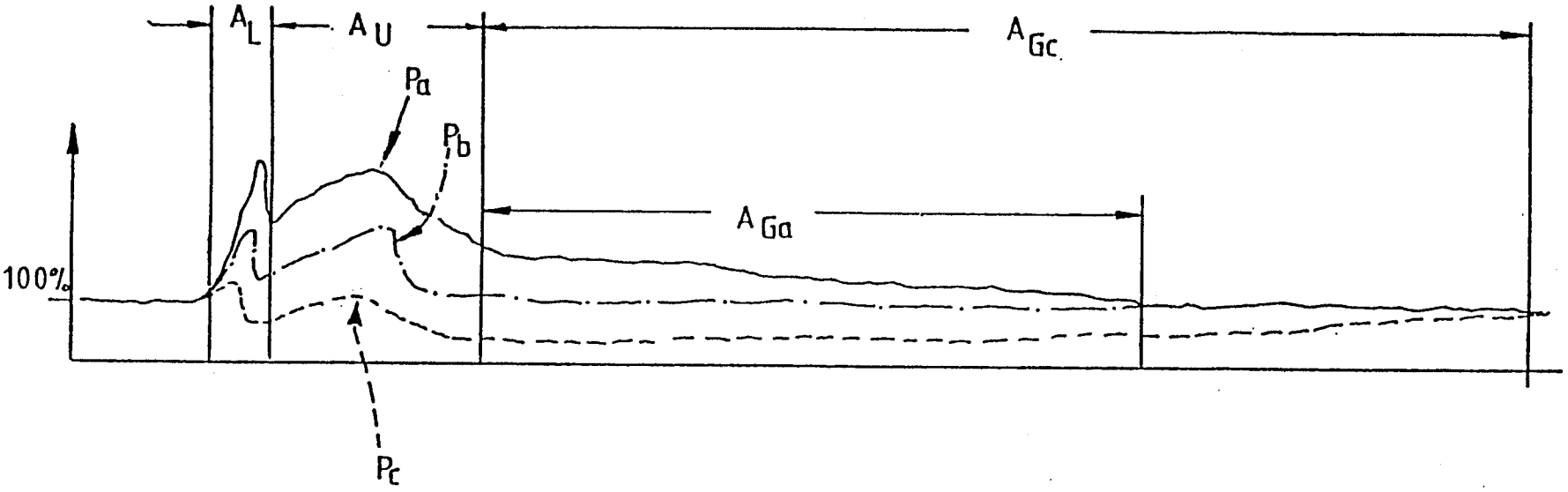
FIG. 33 is a schematic view which shows different piecing joints.

FIG. 33 shows a piecing joint as produced in a process according to FIG. 5. The piecing joint $P_a$ (continuous line) corresponds to fiber feeding $F_a$, the piecing joint $P_b$ (line of dots and dashes) corresponds to fiber feeding $F_b$ and the piecing joint $P_c$ (broken line) corresponds to fiber feeding $F_c$. As can be seen from FIG. 33, a piecing joint consists, as a rule, of three length segments.

In a first length segment $A_L$. in which the back-fed yarn end $E_G$ and the fiber ring $R_F$ overlap and which contains the wild windings W, the piecing joint is particularly thick.

In a second length segment $A_U$ the piecing joint still has a thickened cross-section, as a rule, due to the fact that the fiber ring $R_F$ which was present before back-feeding $G_R$ of the yarn to the fiber collection surface 160 has been incorporated and that new fibers, which were also incorporated into this length segment $A_U$, had been deposited on this fiber ring $R_F$. The two length segments $A_L$ and $A_U$ have, together, a total length which is predetermined by the circumference U of the fiber collection surface 160 in case of a spinning rotor 16.

In the ideal case the piecing joint already has the desired thickness (see piecing joint $P_b$) as of the end of the length segment $A_U$ so that the mentioned third length segment is absent in this case. In all other cases, however, a third length segment $A_{Ga}$ or $A_{Gc}$ which is either thicker or thinner than the yarn and may have different lengths follows the length segments $A_L$ and $A_U$.

The creation of the different thicknesses in these length segments $A_L$, $A_U$ and $A_{Ga}$ or $A_{Gb}$ shall be explained below through the embodiment of FIGS. 7 to 12.

Figure 7:
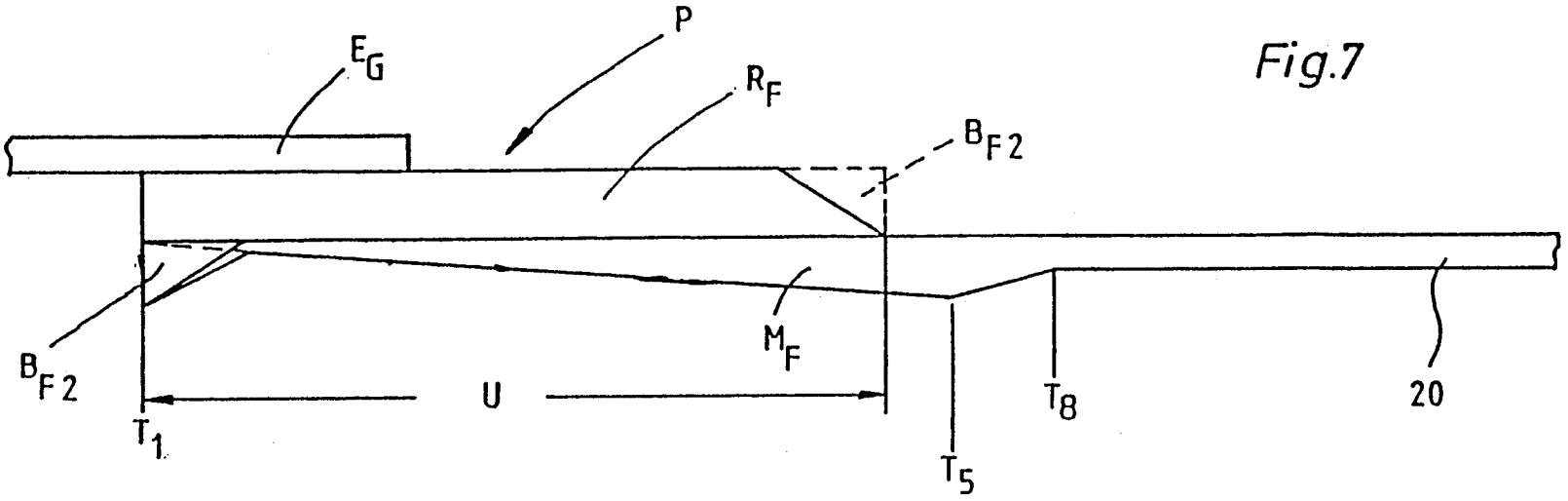
FIG. 7 is a schematic view which shows the yarn end, the fiber ring and the beginning of the yarn, in a known process, according to FIG. 5.
Figure 8:
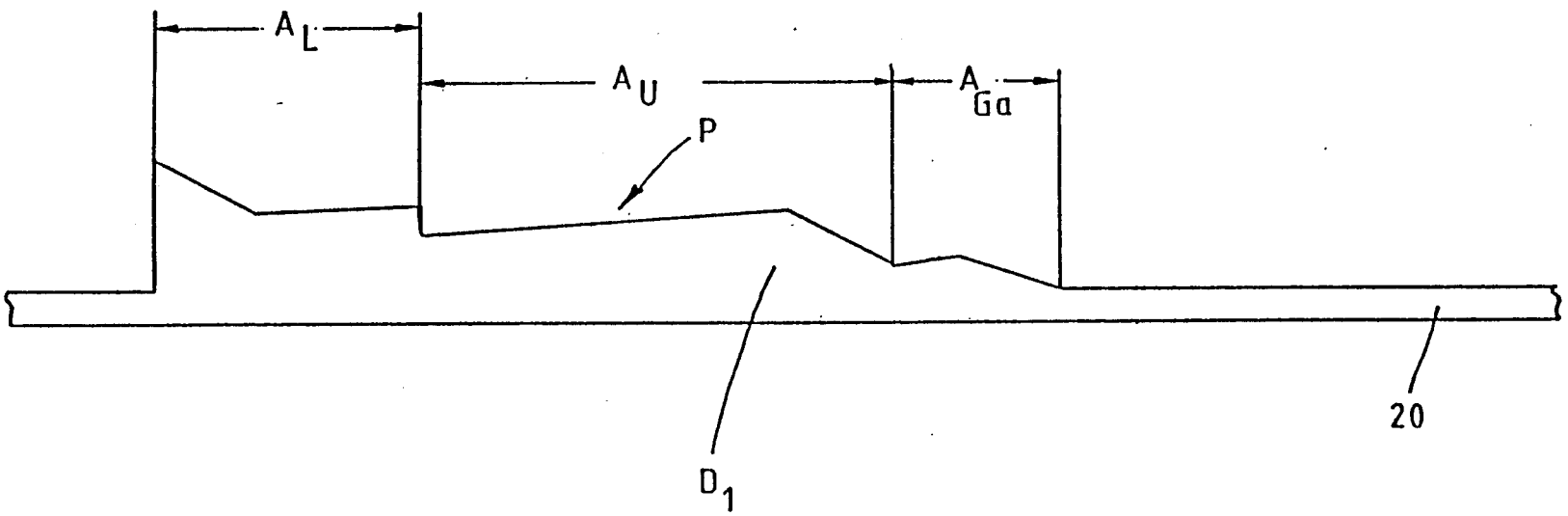
FIG. 8 is a schematic view which shows the distribution of the mass in a piecing joint, according to FIG. 7.

FIGS. 7 and 8 show the piecing joint P for fiber feeding $F_a$ (FIG. 5). It can be seen that the yarn end $E_G$ has been deposited on a portion of the circumference U of the fiber collection surface 160. As of the beginning of the fiber feeding $F_a$ the fibers 22 are deposited in the spinning rotor 16 on the fiber collection surface 160 and form, in part, on the yarn end $E_G$, a fiber ring $R_F$. When the draw-off $G_A$ starts, the fiber ring $R_F$ is torn up, where not only fibers which, in relation to the point of incorporation $P_E$, are on the side towards the free end of the yarn end $E_G$ (arrow $f_2$-fiber bridge $B_{F1}$), are incorporated into the yarn end $E_G$, but also fibers on the other side of the point of incorporation $P_E$ (fiber bridge $B_{F2}$). Fiber bridge $B_{F2}$ thus reaches the location on piecing joint P on which the fiber ring fiber ring $R_F$ is burst open (FIG. 7, left side). The piecing joint P thus begins at point in time $T_1$ with a very pronounced jump in cross section.

During the time until draw-off $G_A$ has reached its full value (100%), fiber feeding $F_a$, in relation to its full production value, always precedes $G_A$ so that the fiber mass $M_F$ accumulating on the fiber collection surface 160 increases. When fiber feeding $F_a$ has attained its production value (100%), (after a run-up time $t_{Fa}$) as is the case according to FIG. 7, once the point of incorporation $P_E$ has made more than one revolution in the spinning rotor 16, so that the entire original fiber ring $R_F$ is drawn off from the fiber collection surface 160 (see point in time $T_5$ in FIGS. 5 and 7). Further fiber feeding $F_a$ remains constant while the speed of draw-off $G_A$ continues to increase. The fiber mass $M_F$, which now accumulates on the fiber collection surface 160, gradually decreases and finally reaches again its normal value which is the one of the desired mass of yarn 20 at the point in time $T_8$.

Yarn 20 thus receives a distribution of mass in accordance with FIG. 8. A thick spot $D_1$ made up of the back-fed yarn end $E_G$, the fiber ring $R_F$, and the windings W, which are constituted by the fibers of the fiber bridge $B_{F2}$, follows the yarn end $E_G$. The thick spot $D_1$ is at first somewhat reduced as the effect of the fiber bridge $B_{F2}$ decreases. The thick spot $D_1$ again increases after this point up to the end of the back-fed yarn end $E_G$, to decrease suddenly thereafter. The increase of the fiber mass $M_F$ due to delayed run-up of draw-off $G_A$ however causes the thick spot $D_1$ to thicken further up to point in time $T_5$, said thick spot $D_1$ being then reduced until point in time $T_8$. Starting at this point the newly spun yarn 20 has attained its desired thickness.

FIGS. 7 and 8 show that a long and thick piecing joint P is obtained in a known process with a fiber feeding $F_a$.

With a fiber feeding $F_b$ the latter attains its full production value (100%) only at the point in time $T_6$, i.e. later than at the point in time $T_8$ when the yarn draw-off $G_A$ has already attained its full production value (100%) (see FIGS. 9 and 10). A thick spot $D_2$ which is not as pronounced as the thick spot $D_1$, is thereby produced. As of the moment when the fiber ring $R_F$ has been fully incorporated into the piecing joint, a thick spot $D_3$ which attains its thinnest point at point in time $T_8$ and ends at point in time $T_6$ then follows this thick spot $D_2$.

Figure 9:
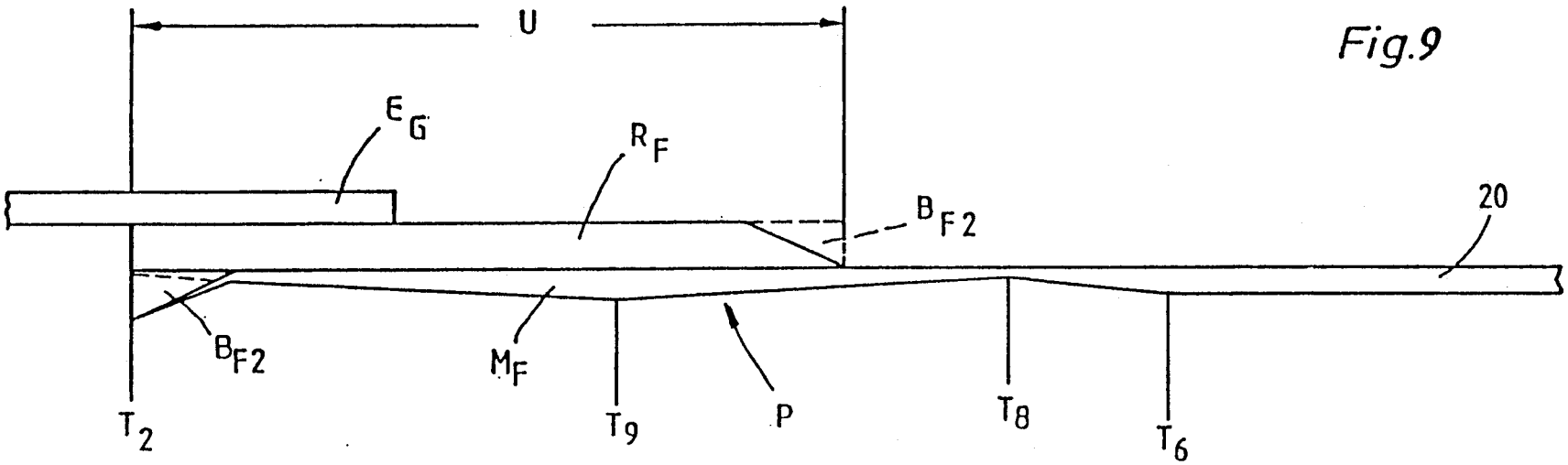
FIG. 9 is a schematic view which shows another yarn end, the fiber ring as well as the beginning of the yarn in a process according to FIG. 5.
Figure 10:
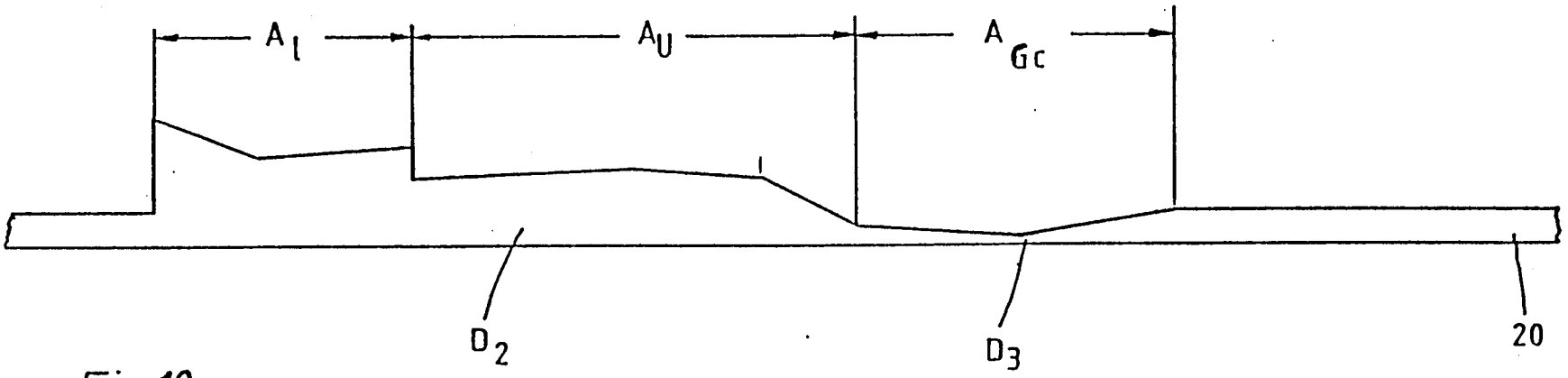
FIG. 10 is a schematic view which shows the distribution of the mass in a piecing joint according to FIG. 9.
Figure 11:
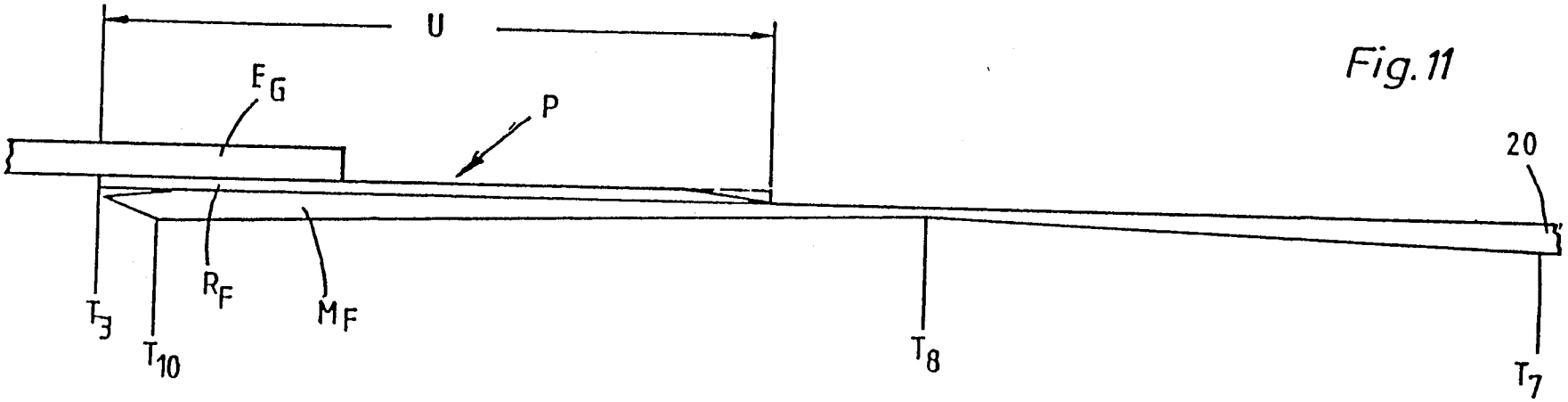
FIG. 11 is a schematic view which shows a further yarn end, the fiber ring as well as the beginning of the yarn in a process, according to FIG. 5.

The piecing joint P which is produced when fiber feeding $F_c$ increases very slowly is shown in FIGS. 9 and 11. Only a very thin fiber ring $R_F$ is able to build up from point in time $T_3$ to point in time $T_4$. The fiber mass $M_F$ continues to increase up to point in time $T_{10}$ and then decreases again up to the point in time $T_8$. The fiber mass then increases once more up to point in time $T_7$. From here on the fiber mass is that of the normal yarn 20. In this manner, a short thick spot $D_4$ is, therefore, produced, followed by a long thin spot $D_5$ which starts even before the fiber ring $R_F$ is fully incorporated into the piecing joint P and continues until point in time $T_7$. The piecing joint P is, thus, extremely weak and generally fails.

Figure 13:
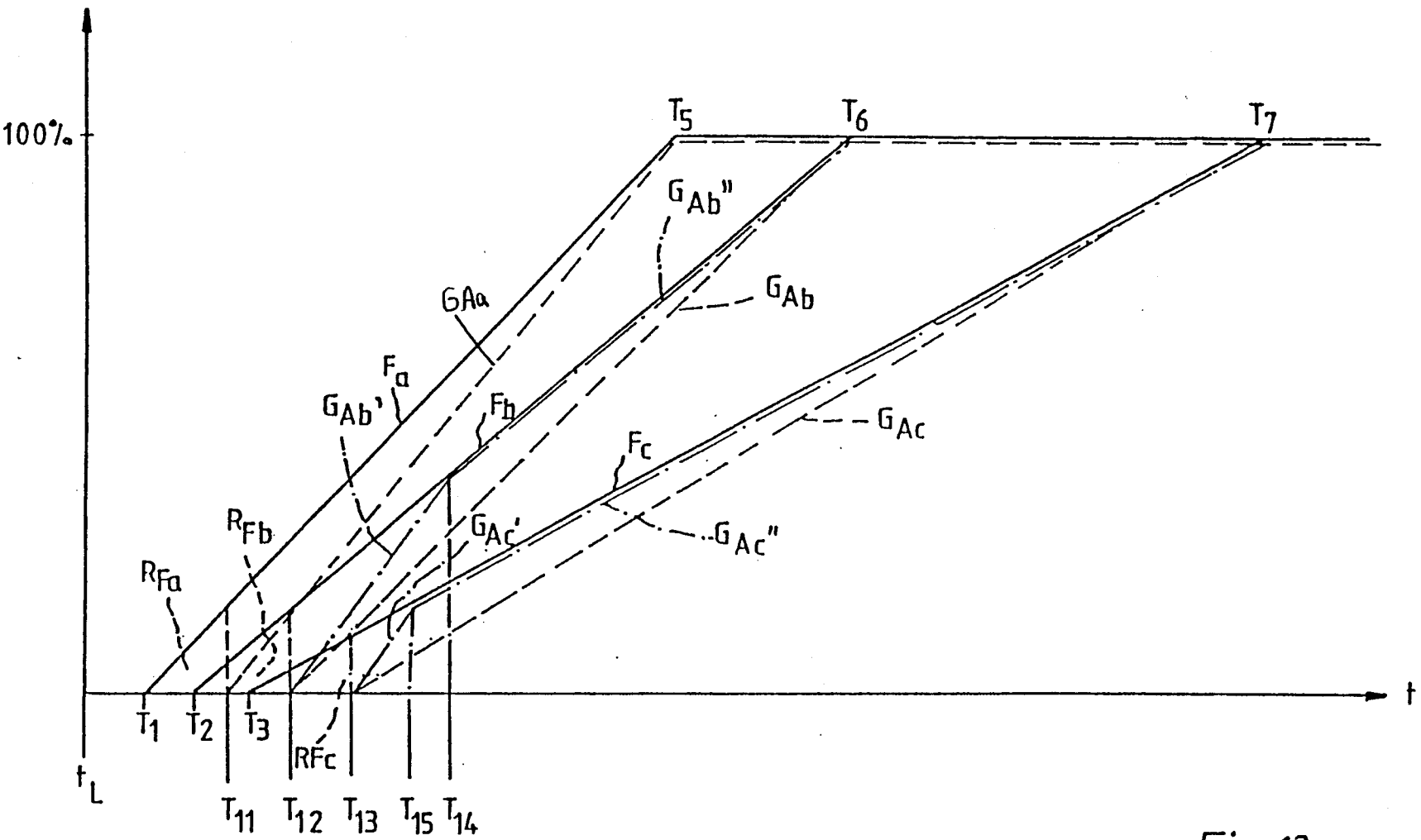
FIG. 13 is a diagram of a first example of the process, according to the invention.

In order to increase piecing reliability, the yarn draw-off $G_A$ is adapted to the combed-out state of the fiber tuft 21 (see FIG. 1) in the process shown in FIG. 13. This means that the acceleration of yarn draw-off $G_A$ is controlled as a function of the combed-out state of fiber tuft 21 so as to be greater if the depletion of fiber tuft 21 has been slight, and lesser if the depletion of the fiber tuft 21 is great.

As is shown in FIG. 13, yarn draw-off $G_{Aa}$ with great acceleration is selected with rapid fiber feeding $F_a$, yarn draw-off $G_{Ab}$ with average acceleration for average fiber feeding $F_b$ and yarn draw-off $G_{Ac}$ with little acceleration for slow fiber feeding $F_c$. As fiber feeding $F_a$, $F_b$ and $F_c$ begins at different points in time $T_1$, $T_2$ and $T_3$, the point in time $T_{11}$, $T_{12}$, $T_{13}$ is also selected differently for the beginning of yarn draw-off $G_{Aa}$, $G_{Ab}$ and $G_{Ac}$ so that a fiber tuft $R_{Fa}$, $R_{Fb}$ or $R_{Fc}$ is formed. If the fiber tuft 21 has been severely depleted, such as, for instance, after a long stoppage of the feeding device 110 while the opener device 116 continues to run, draw-off $G_A$ starts later, in this case, than if the fiber tuft 21 has been depleted less severely. The acceleration of draw-off is then selected so that yarn draw-off $G_{Aa}$, $G_{Ab}$ or $G_{Ac}$ reaches full production value (100%) at the same time as the corresponding fiber feeding $F_a$, $F_b$ or $F_c$. At the same time, if the fiber tuft 21 has only been slightly depleted, the yarn 20 is brought rapidly to production speed (see $t_5$) after a brief delay (see $T_{11}$) as compared with the release of fiber sliver 2 (see $t_L$). If the fiber tuft has been severely impaired, yarn 20 is accelerated more slowly than in the case of slight depletion of the fiber sliver 21 after a delay (see $t_{12}$) that is longer than in that case, so that fiber feeding and fiber draw-off reach full production speed (100%) as much as possible at the same time, as in the first case. If the depletion has been severe the start of the yarn draw-off is again delayed (see $t_{13}$) more than in the case of average depletion, and the yarn draw-off is brought as rapidly as possible to the same percentage velocity value as the fiber feeding $F_c$ (see $t_{15}$) to then run up synchronously with it. The transitions are flowing, as explained already in connection with FIG. 32.

Figure 12:
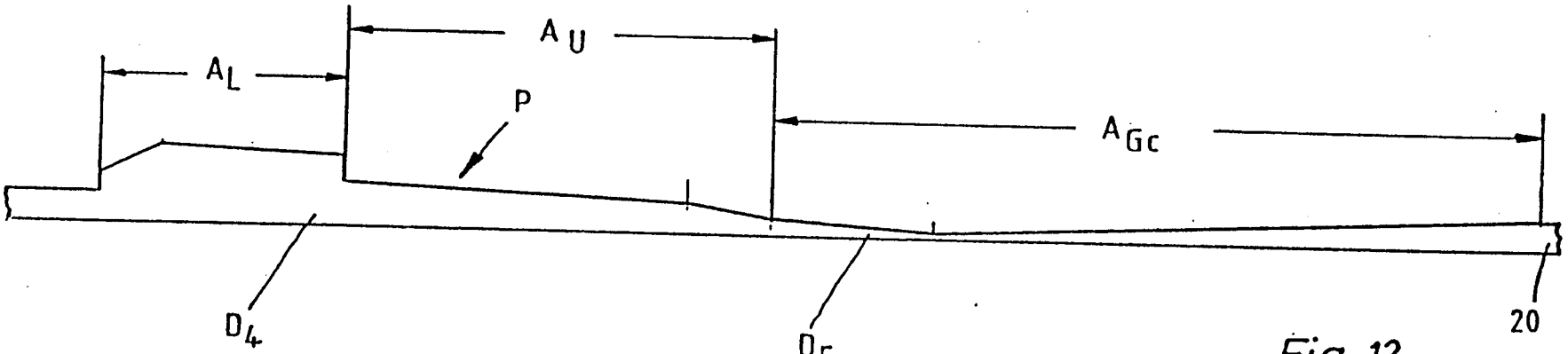
FIG. 12 is a schematic view which shows the distribution of mass in a piecing joint, according to FIG. 11.
Figure 14:
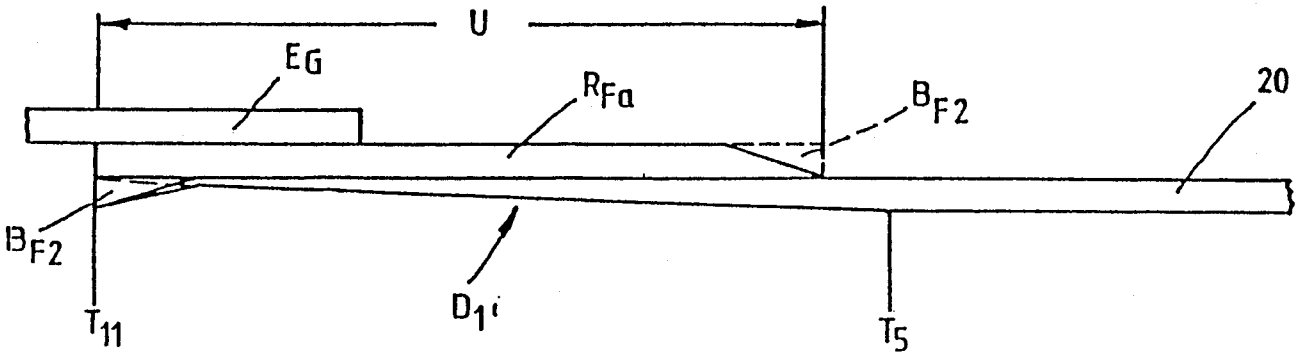
FIGS. 14 to 18 are schematic views which show the yarn end, the fiber ring, and the beginning of the yarn in a process, according to FIG. 13.
Figure 15:
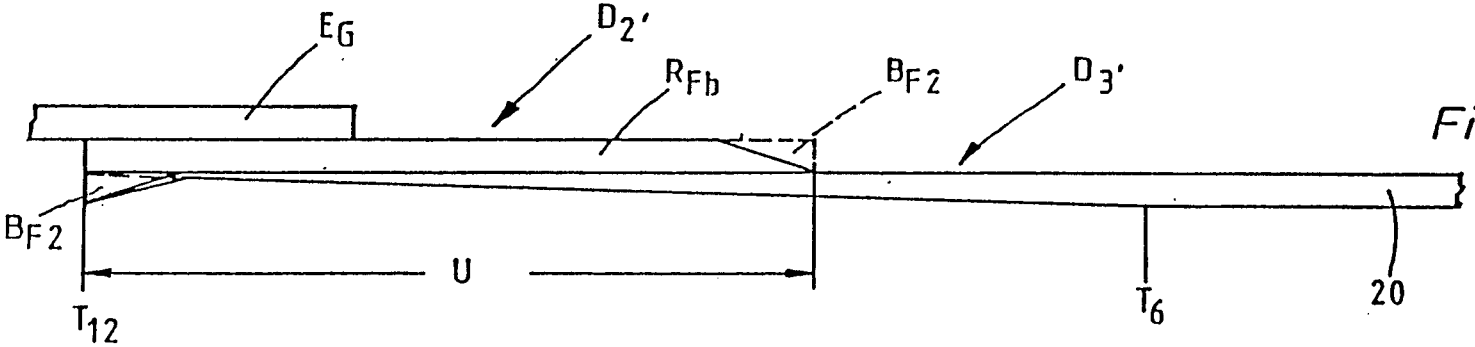
Figure 16:
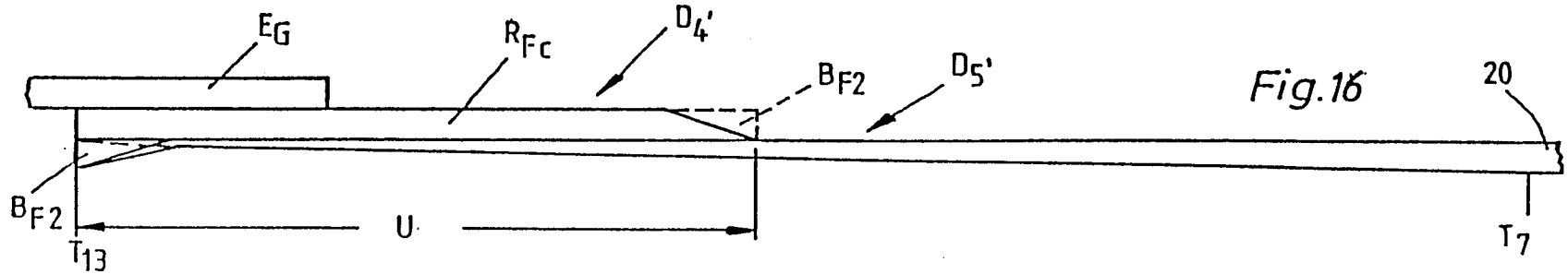

As FIGS. 14, 15 and 16 show, the thick spot $D_1$, is less pronounced than the thick spot $D_1$ (FIG. 8), just as thick spot $D_2$, and thin spot $D_3$, are less pronounced than thick spot $D_2$ and thin spot $D_3$ (FIG. 10) and the thick spot $D_4$, and the thin spot $D_5$, are also less pronounced than the thick spot $D_4$ and the thin spot $D_5$ (FIG. 12).

An even less obtrusive piecing joint P is produced if yarn draw-off $G_A$ is not subjected to a linear acceleration but is accelerated at first as rapidly as mechanically possible as of the moment when yarn draw-off $G_A$ and fiber feeding F have reached the same percentage value, synchronously with the increase of fiber feeding F.

This process is also shown in FIG. 13 in connection with fiber feeding fiber feeding $F_a$, $F_b$ and $F_c$.

Figure 20:
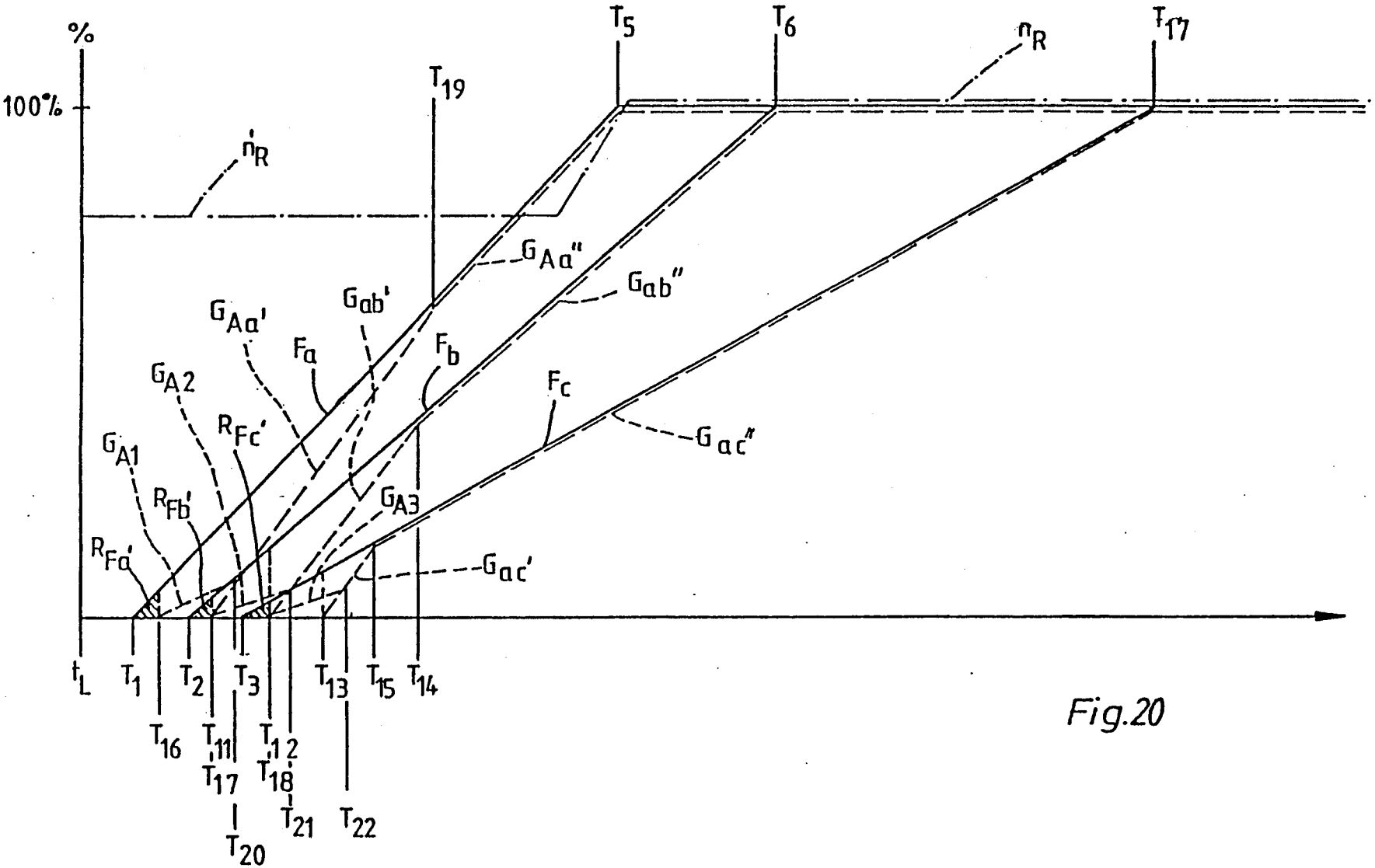
FIG. 20 is a diagram of a second embodiment of the process, according to the invention.

The yarn back-feeding $G_R$ was not shown for the sake of clarity (as in FIG. 20). It takes place when the feeding device 110 is switched on at a point in time that is such that the yarn draw-off $G_A$ may be effected in the manner shown after a desired or after an unavoidable sojourn period on the fiber collection surface 160.

According to FIG. 13, the yarn draw-off is subdivided into phases $G_{Ab}'$ (between points in time $T_{12}$ and $T_{14}$) and $G_{Ab}''$ (between points in time $T_{13}$ and $T_{15}$) instead of the linear yarn draw-off $G_{Ab}$.

Figures 17, 18, 19:
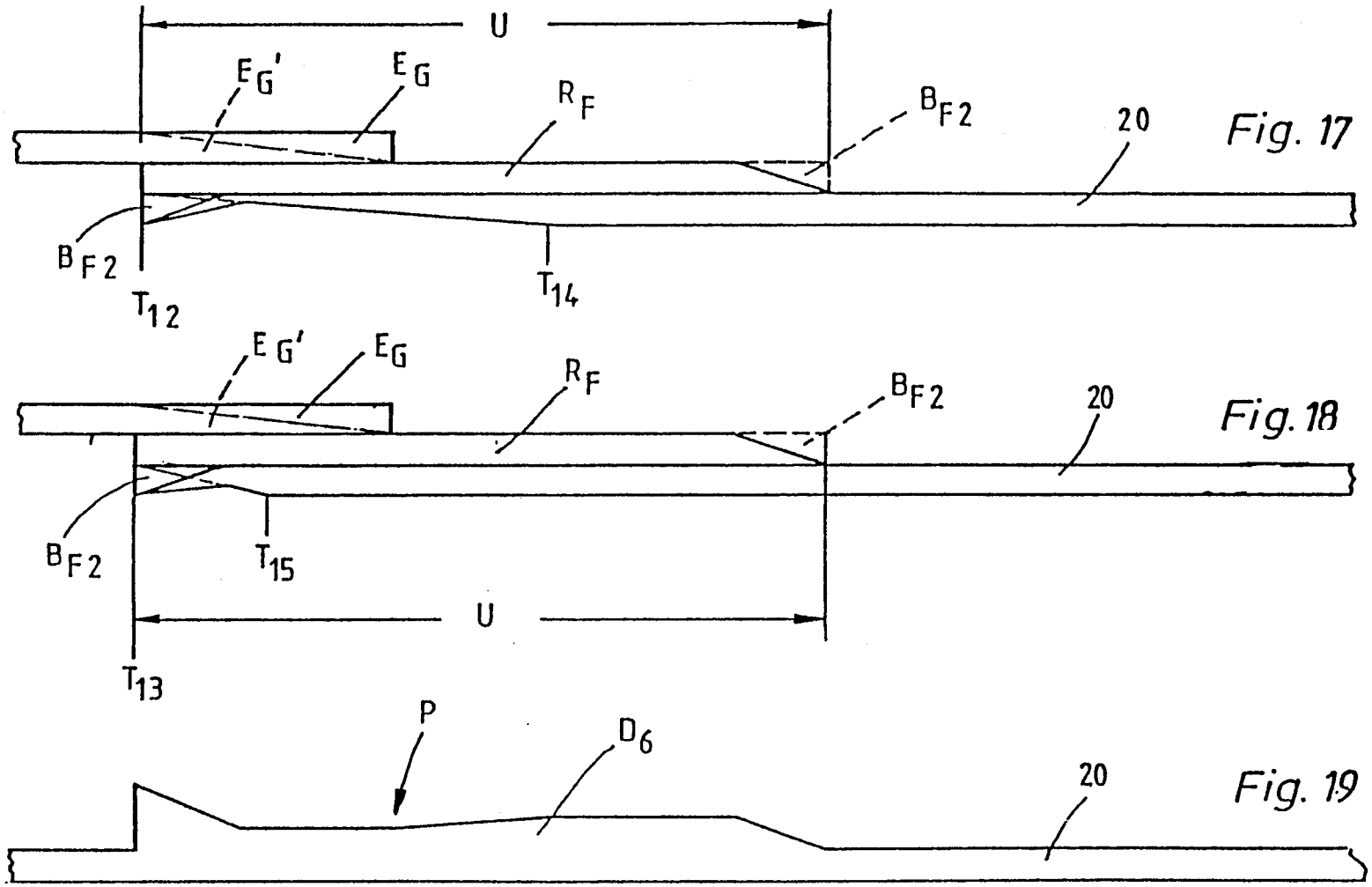
FIG. 19 is a schematic view which shows the distribution of mass in a piecing joint, according to FIG. 17.

FIGS. 17 and 18 show that yarn 20 already attains its desired thickness as of the point in time when the fiber ring $R_F$ is incorporated. The piecing joint is, therefore, very short and does not exceed the length of the fiber ring $R_F$, which is determined by the circumference U of the spinning rotor 16.

FIGS. 17 and 18, furthermore, show that the thickness of the piecing joint is substantially influenced by the thickness of the yarn end $E_G$ and the thickness of the fiber ring $R_F$. The thickness of the yarn end $E_G$ can be reduced by a known pre-treatment so that the yarn end $E_G$, is wedge-shaped. The piecing joint P then has a configuration as shown in FIG. 19, with the length of the thick spot $D_6$ being of the same length as the circumference U of the spinning rotor 16.

As shown in FIGS. 7 to 12 and 14 to 19, the piecing joint P starts with a very considerable increase in diameter by comparison with the back-fed yarn end. This sudden jump in diameter is due to the fiber ring $R_F$ and the fiber bridge $B_{F2}$ which is produced by the breaking-up of the fiber ring $R_F$ and winds itself around the yarn in form of windings W (see FIG. 5). This heavy-thickness zone of piecing joint P is a fault in the yarn 20, if only from the point of view of appearance. In addition this thick piecing joint P leads to greater centrifugal forces. To be able to incorporate this large fiber mass into yarn end $E_G$ properly it is necessary that sufficient twist reaches the piecing joint. A high rotor speed is required for this, and this involves the danger, on the other hand, that the piecing joint P may be twisted off.

As a remedy, and depending on the acceleration of the fiber flow (fiber feeding $F_a$, $F_b$ or $F_c$), a process according to FIG. 20 is disclosed in which the yarn 20 is subjected to a multi-phase acceleration.

Since the yarn reaches its desired thickness only when fiber feeding F and yarn draw-off $G_A$ have the same percentage value, i.e. if they run-up synchronously, this value must be reached as soon as possible. On the other hand however, a fiber ring $R_F$ should be avoided as much as possible in order to avoid the fiber bridge $B_{F2}$. This goal is reached in the processes according to FIG. 19 in that, although the yarn draw-off $G_A$ starts early so that only a very narrow fiber ring $R_F$ has formed in the spinning rotor 16, the acceleration of the draw-off is, nevertheless, so low in a first phase of the yarn draw-off that a growing fiber accumulation is able to form on the yarn end $E_G$ in the process of being drawn off. Because yarn draw-off $G_A$ is already in effect, however, a closed fiber ring $R_F$ can no longer form.

Figures 21, 22, 23:
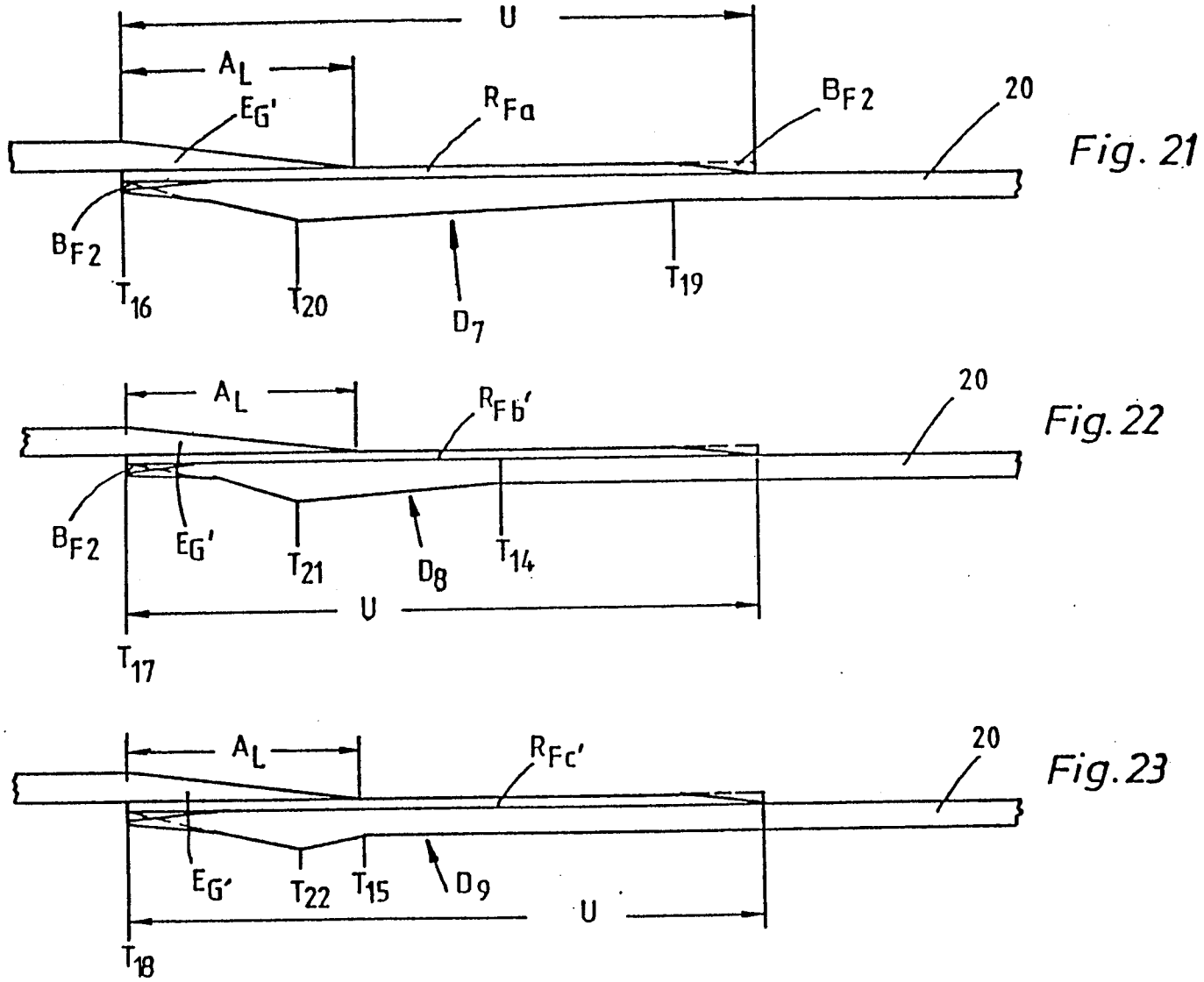
FIGS. 21 to 23 are views which schematically show the yarn end, the fiber ring, and the beginning of the yarn in a process, according to FIG. 20.

The start of yarn draw-off $G_A$ is delayed with respect to the yarn feeding F so that a fiber ring $R_F$ may form to ensure that the fiber quantity necessary for the piecing joint P can accumulate in the spinning rotor. As compared with the process shown in FIG. 13, yarn draw-time off begins with its phase $G_{A1}$, $G_{A2}$ or $G_{A3}$ at a point in $T_{16}$, $T_{17}$, or $T_{18}$, when the fiber ring $R_{Fa'}$, $R_{Fb'}$, or $R_{Fc}$, is still substantially smaller than the fiber ring $R_{Fa}$, $R_{Fb}$, or $R_{Fc}$ shown in FIG. 13. During this phase the fiber ring $R_F$ is broken up in rotor spinning devices. The yarn draw-off begins here all the earlier as the fiber flow increases more rapidly, i.e. earlier with slight depletion of the fiber tuft 21 than with greater or even severe depletion of the fiber tuft. Yarn draw-off is accelerated very slowly at first until the fiber mass forming in the spinning rotor 16 has increased to such an extent that secure incorporation of the fibers continuing to enter the spinning rotor 16 into the yarn end $E_G$ is ensured. This phase of the slow draw-off acceleration is required until the fibers 22 are spun into the back-fed yarn end $E_G$ and until the length segment $A_L$ (see FIGS. 21 to 23) in which the yarn end $E_G$ and the newly forming yarn overlap has left the fiber collection surface 160. This completes also the most delicate phase of the piecing.

The manner in which the draw-off speed increases as rapidly as the conditions of the device used permit is described below. Since the draw-off rollers 130, 131 must be accelerated to higher rotational speeds than the feeding roller 111 because of the required draft of the fiber material, it takes longer, as compared to the feeding roller 111 until the draw-off speed has reached the same percentage value as the feeding roller 111.

When draw-off $G_A$ has reached the same percentage value as fiber feeding F, the acceleration of the draw-off $G_A$ is reduced so that the draw-off $G_A$ and the fiber feeding F then run up synchronously to their production speed values (100%). The yarn draw-off $G_A$ is thus effected again in several phases of different accelerations.

In the first phase $G_{A1}$, $G_{A2}$, $G_{A3}$ yarn draw-off is accelerated only very slowly in such a manner that optimal conditions are created for the incorporation of the fibers 22 into the yarn end $E_G$. The draw-off acceleration is so low that the tearing up of the fiber tuft $R_{Fa'}$, $R_{Fb'}$, or $R_{fc}$, is not too violent. For it has been found that if the fiber ring is torn up too violently by the fiber bridge $B_{F2}$, often large clumps of fibers are torn in an uncontrolled manner by the yarn end $E_G$ from the fiber ring $R_F$ so that a pronounced thick spot is produced at the beginning of the piecing joint P. Slow drawing-off of yarn end $E_G$ from the fiber collection surface 160 makes it possible for the twist produced by the rotating spinning rotor 16 to be propagated beyond, up to the point of incorporation $P_E$. For this reason, the lesser the propagation of twist to the fiber collection surface, the slower is the draw-off acceleration in the first phase of the draw-off acceleration.

A second phase $G_{A1}$, $G_{A2}$ or $G_{A3}$, during which the draw-off acceleration is adapted to the increase of fiber flow follows the first phase $G_{A1}$, $G_{A2}$ or $G_{A3}$ which is ended at the point in time $T_{20}$, $T_{21}$ or $T_{22}$. The point in time $T_{20}$, $T_{21}$ or $T_{22}$ is selected so that the yarn end $E_G$ has just left the fiber collection surface 160. In this second phase $G_{Aa'}$, $G_{Ab'}$, or $G_{Ac}$, the draw-off acceleration is as great as the device effecting yarn draw-off permits. The length segment $A_L$ has already left the fiber collection surface 160 during this phase $G_{Aa'}$, $G_{Ab'}$, or $G_{Ac}$, so that a new yarn 20 which is not as fragile as the length segment $A_L$ is already being produced, so that this greater draw-off acceleration can absolutely be supported by the yarn 20.

If draw-off acceleration and fiber flow have reached the same percentage value in relation to their production values (see point in time $T_{19}$, $T_{14}$ or $T_{15}$), the acceleration ratio is maintained constant in a third phase $G_{Aa''}$ $G_{Ab''}$ or $G_{Ac''}$ so that draw-off and fiber flow run up together to their production values (100%). As of point in time $T_{19}$, $T_{14}$ or $T_{15}$ the newly produced yarn has, therefore, already the desired mass.

Figure 24:
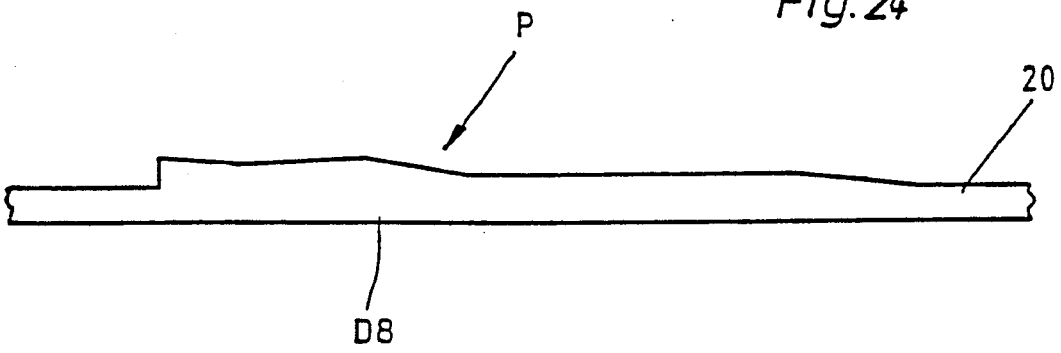
FIG. 24 is a view which schematically shows the distribution of the mass in a piecing joint, according to FIG. 22.

FIGS. 21 to 24 show a piecing joint P which has been produced through the process shown in FIG. 20. FIG. 24 shows here the piecing joint of FIG. 22 in a different representation.

Within the overlap zone of yarn end $E_G$ and fiber ring $R_F$ a thick spot $D_7$, $D_8$ or $D_9$ is naturally produced here too. However, since the fiber ring $R_F$ can be kept very small in this process, the thick spot $D_7$, $D_8$ or $D_9$ is not very pronounced, as is shown through a comparison with the thick spots $D_1$, $D_2$, $D_4$, $D_1'$, $D_2'$, $D_4'$ or $D_6$ of FIGS. 7, 9, 11, 13, 14, 15 and 18. Nevertheless, the overall length of the irregularity caused by piecing which is still equal to the circumference U of the spinning rotor 16. Appropriate pre-treatment in which the yarn end $E_G'$ is given an essentially wedge-shaped configuration before being fed back to the fiber collection surface 160 makes it possible to reduce the irregularity even further.

The increase of fiber feeding F depends essentially also on draft, beside the depletion of the fiber tuft 21. If a thin yarn is produced, for example, and for a draft of 1:150 and a yarn draw-off speed of 150 m/min, 1 m of sliver must be additionally fed per minute. For a thick yarn and identical yarn draw-off speed and a draft of 1:150, 3 m/min of sliver must be fed however. Since the fiber tuft 21 fed to the opener device has, however, been combed out or has possibly also been depleted during the preceding stoppage time, the moment when fiber flow again reaches its full value is a function of the supply of the fiber sliver (see FIG. 1).

In a thin or fine yarn, draft is great so that the fiber sliver is fed relatively slowly to the opener device 116. The run-up curve for fiber flow (fiber feeding $F_c$) is thus flat. With a thick yarn the draft is considerably lower, and the fiber sliver feeding speed is, therefore, all the greater. The run-up curve (fiber feeding $F_a$) is, therefore, steeper.

The increase of fiber feeding is, therefore (and independently of the previously discussed stoppage time $t_{Sa}$, $t_{Sb}$ and $t_{Sc}$), also determined by the draft. For this reason the acceleration of the draw-off is rapid and possibly even sudden with a thick yarn so as to avoid thick spots in said yarn.

The described multi-phase piecing process allows for great piecing reliability. The piecing joints P are stronger than otherwise normal, and for this reason the success rate is also extraordinarily high.

The piecing process having been explained in its nature, it shall be again described below through the embodiment shown in FIG. 4.

During undisturbed spinning operation, the fiber sliver 2 is fed by the feeding device 110 to the opener device 116 and, in the ideal case, is opened by the latter into individual fibers and conveyed in this form to the fiber collection surface (not shown here). The fibers 22 are briefly deposited there and are then incorporated in a known manner into the end of a yarn 20 which is drawn off from the open-end spinning device 11 through a yarn draw-off pipe 119 by means of the pair of draw-off rollers 13. The yarn 20 leaving the pair of draw-off rollers 13 is fed to the winding device 12 and is wound up on bobbin 122.

If a yarn breakage occurs for any reason, this is recorded by the yarn monitor 14 and signalled to the control device 15. At the same time the yarn monitor 14 switches off the feeding device 110 in a known manner via circuits 140 and 156. This is effected in the device shown in FIG. 4 in that the solenoid 115 is excited and thereby pivots the clamping lever 114 in such manner that the fiber sliver 2 is pressed by clamping lever 114 against the feeding tray 112 and said feeding tray 112 is pivoted away from the feeding roller 111.

The computer or control device 15 contains a timing element (not shown) which is caused to start running by the yarn breakage message. If another yarn breakage occurs in another spinning station 10 while this particular timing element runs, another timing element begins to run.

While the service unit 30 travels alongside the open-end spinning machine 1 it interrogates via circuit 303 whether the spinning station 10 which it will reach next is functioning faultlessly or whether a yarn breakage must be repaired at that spinning station 10. If piecing is to be carried out at this spinning station to repair a yarn breakage, the service unit 3 stops and first of all carries out preparations. Among these is, for example, the braking of the spinning rotor 16, the cleaning of the open-end spinning device 11 or of some of its parts, the search for the end of the torn yarn 20 on the bobbin 122, the drawing-off of a yarn length sufficient for piecing, the preparation of the yarn end, the introduction of the yarn end into the yarn draw-off pipe 119, and the running-up of the spinning rotor 16 to its production speed.

These steps are controlled in a known manner by the control device 30. When the preparations are completed the actual piecing can begin.

Starting at the point in time when the service unit 3 is stopped at the spinning station 10 during and until the completion of the piecing process, all operations are precisely set in time, it being possible to pre-set different time sequences individually as desired in adaptation to material, yarn thickness, etc. In any case, the point in time at which the feeding device 110 is to be switched back on is already set when the service unit 3 stops at the spinning station 10. Since the service unit 3 is connected via circuit 303 to the control device 15 in a constant exchange of data, the control device 15 is also informed of the point in time when this stop is made. From this, and taking into account the point in time when the yarn monitor 14 has been triggered, the control device can derive the stoppage time $t_{Sa}$, $t_{Sb}$ or $t_{Sc}$ and can, accordingly, set the time between the moment when fiber feeding is switched on and the beginning of yarn draw-off by means of a timing element (not shown here).

The device is described below in connection with a process according to FIG. 3*a*). An appropriate program 150, 151 or 152, which is communicated to the control device 30 of the service unit 3 is selected via a switch 153, 154 or 155 as a function of the stoppage time $t_{Sa}$, $t_{Sb}$ or $t_{Sc}$. Once the yarn end $E_G$ has been fed back to the fiber collection surface of the open-end spinning device 11 at a point in time matched to the point in time $t_L$ for the switching on of the feeding device 110, and when the feeding device 110 has been restarred, the service unit 3 correspondingly selects the point in time $t_L$ for the startup of the yarn draw-off and for its run-up time $t_G$ (FIG. 5). Yarn draw-off $G_A$ follows here in the known manner through auxiliary drive roller 311 and/or the pair of draw-off rollers 13.

The speed of the feeding device 110 cannot be controlled, and, therefore, the fiber sliver 2 is either stopped by taking the feeding device 110 out of action or is fed at production speed to the opener device 116 when the feeding device 110 is switched back on.

The control device 15 with its timing elements (not shown) is, among other things, a device which ascertains the combed-out state of the fiber tuft 21 and controls draw-off $G_A$ as a function thereof via control device 30 of the service unit 3. In this case, it is possible to provide one control device 15 per machine or jointly for a group of open-end machines.

A fiber sliver 2 which has previously been stopped at the occurrence of a yarn breakage is started up again for the piecing by the feeding device 110 as described above, and the stoppage time $t_{Sa}$, $t_{Sb}$ or $t_{Sc}$ is recorded. This can be done, indirectly, by determining the point in time $t_L$ at which the feeding device 110 is switched on in the manner described. The point in time $t_L$ can however also be detected directly and an appropriate signal can be transmitted by the feeding device 110 which has been switched back on to the control device 15 which then initiates yarn draw-off $G_A$.

Depending on the stoppage time $t_{Sa}$, $t_{Sb}$ or $t_{Sc}$, thus found, the speed of yarn draw-off is now adapted to the moment when fiber feeding becomes effective by controlling the acceleration of yarn draw-off $G_A$ accordingly. The shorter the stoppage time $t_{Sa}$, $t_{Sb}$ or $t_{Sc}$, the shorter is the run-up time in this case, and the longer the stoppage time $t_{Sa}$, $t_{Sb}$ or $t_{Sc}$, the longer is the run-up time. The yarn draw-off speed is thus accelerated more rapidly in case of a short stoppage time $t_{Sa}$ than in case of a long stoppage time $t_{Sc}$. The shorter the stoppage time $t_{Sa}$, $t_{Sb}$ or $t_{Sc}$, the shorter also is the waiting time $t_W$ for the onset of yarn draw-off $G_A$.

As was explained above, the time it takes until the fiber tuft 21 has increased to full strength depends on the length of the stoppage time $t_{Sa}$, $t_{Sb}$, $t_{Sc}$ so that the run-up time $t_{Fa}$, $t_{Fb}$, or $t_{Fc}$ is of different length. As has also been described earlier, not only the run-up time $t_{Fa}$, $t_{Fb}$ or $t_{Fc}$, but also the delay $t_{Va}$, $t_{Vb}$ or $t_{Vc}$ until the fibers 22 reach the opener device 116 and from there the fiber collection surface of the open-end spinning device 11 depend on the length of this stoppage time $t_{Sa}$, $t_{Sb}$ or $t_{Sc}$.

As explained above, a different draw-off acceleration is required depending on the duration of the stoppage time $t_{Sa}$, $t_{Sb}$ or $t_{Sc}$. When the required draw-off acceleration in the second and possibly third phase becomes greater, a corresponding bobbin acceleration is no longer automatically possible, especially not if the bobbin 122 has a large diameter to start with. Instead of carrying out the draw-off acceleration by means of the auxiliary drive roller 311, as is generally customary, the bobbin 122 is, in this case, brought to bear against the winding roller 120 rotating at production speed for the second and possibly for the third draw-off phase, and the pressure bearing on bobbin 122 in this or these acceleration phases is increased so that the normal weighing devices and the weight of the bobbin 122 do not act alone. On the bobbin side away from the winding roller 120, a device to increase the contact pressure is provided to press the bobbin 122 with increased pressure against the winding roller 120 so that the slippage between winding roller 120 and its drive is reduced and a better driving effectiveness and, thereby, better bobbin acceleration is achieved.

Figure 27:
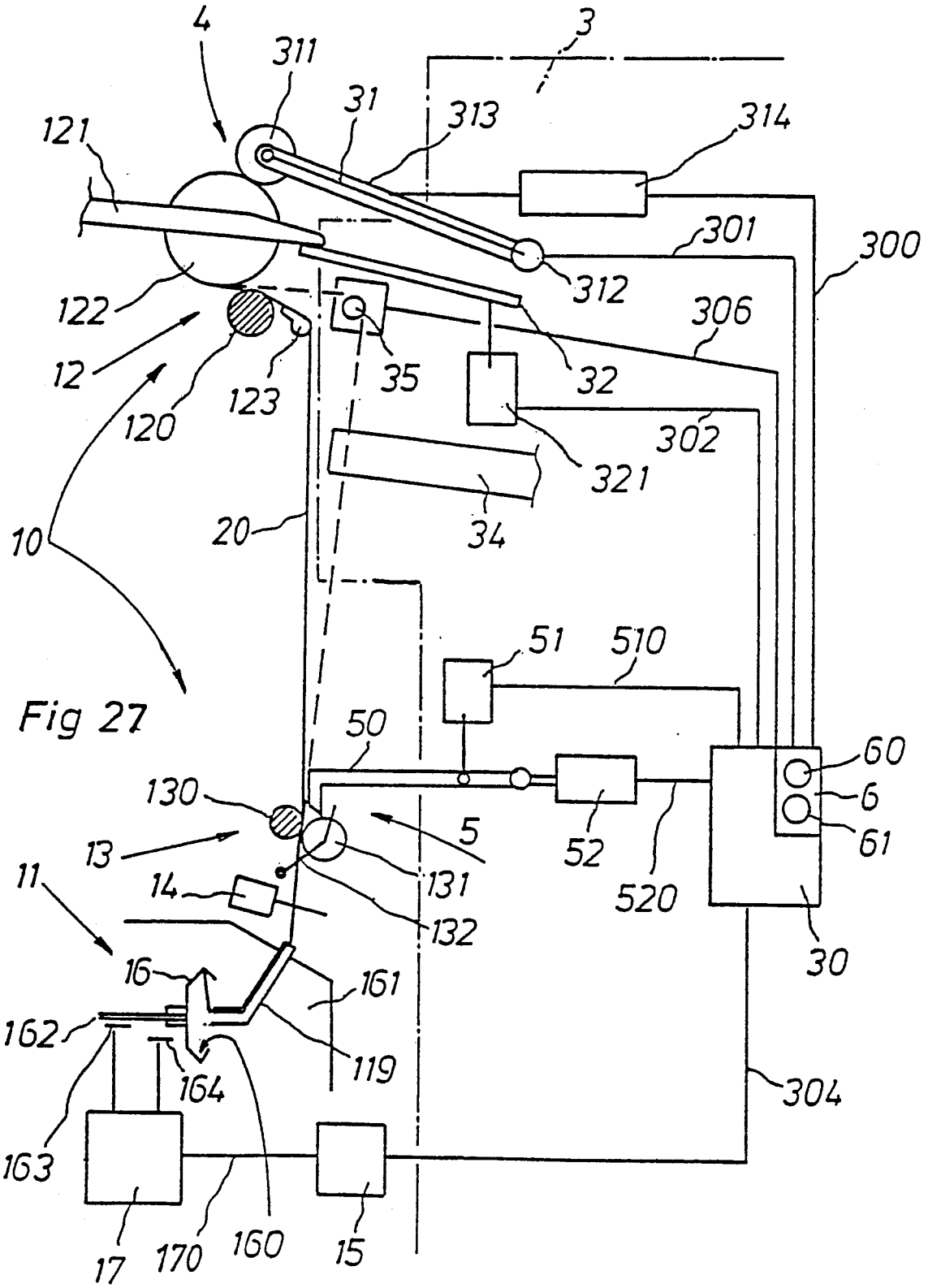
FIG. 27 is a schematic side view of an open-end rotor spinning device, designed according to the invention.

According to FIG. 27, this device to increase the contact pressure is constituted by a pressure roller which is identical with the auxiliary drive roller 311 in the embodiment shown. This auxiliary drive roller 311 is pressed in the piecing phase in the desired manner with especially high pressure against the winding roller 120. The auxiliary roller 311 is driven at a corresponding controlled speed to obtain especially rapid acceleration and possibly also at production speed. While it is being driven with increased acceleration, the bobbin 122 is therefore subjected to the effect of two drives (drive 12 and auxiliary drive roller 311) on opposite sides of the bobbin 122.

If the draw-off acceleration achieved by means of bobbin 122 is still insufficient to keep the yarn 20 under tension between the pair of draw-off rollers 13 and bobbin 122, yarn 20 is drawn off during the first phase of draw-off acceleration by means of bobbin 122 and, then, in the second and possibly in a third phase, by the pair of draw-off rollers 13, of which at least the draw-off roller 130 is driven at production speed. The draw-off roller 131 can be driven at first, at a slower speed if desired, as shall be described further on.

Fiber feeding $F_a'$ to the fiber collection surface of the open-end spinning machine 11 can, as is known, be effected by means of a device which is designed and controlled in such manner that the fibers combed out of the fiber tuft 21 are either fed to the fiber collection surface 160 or are deflected and removed on their way to the fiber collection surface so that they do not even reach this fiber collection surface 160. To achieve this, the fibers 22 of a previously released fiber silver 2 are, first of all, sucked away from their conveying path between feeding device 110 and fiber feeding channel 118 (FIG. 4) before they reach the fiber collection surface 160. This aspiration is then suddenly interrupted by means of this device which is connected for control of the piecing process to the control device 30, so that the negative spinning pressure prevailing in the open-end spinning device 11 feeds the fibers 22 to the fiber collection surface 160. At the moment when fiber suction is terminated, there exists, in that case, no fiber tuft 21 in any way different from the fiber tuft 21 during the normal spinning process. The stream of fibers sweeps past the known devices of this type at the inlet opening of the fiber feeding channel 118 and upon completion of the fiber aspiration suddenly enters the fiber feeding channel 118 and reaches the fiber collection surface.

Figure 25:
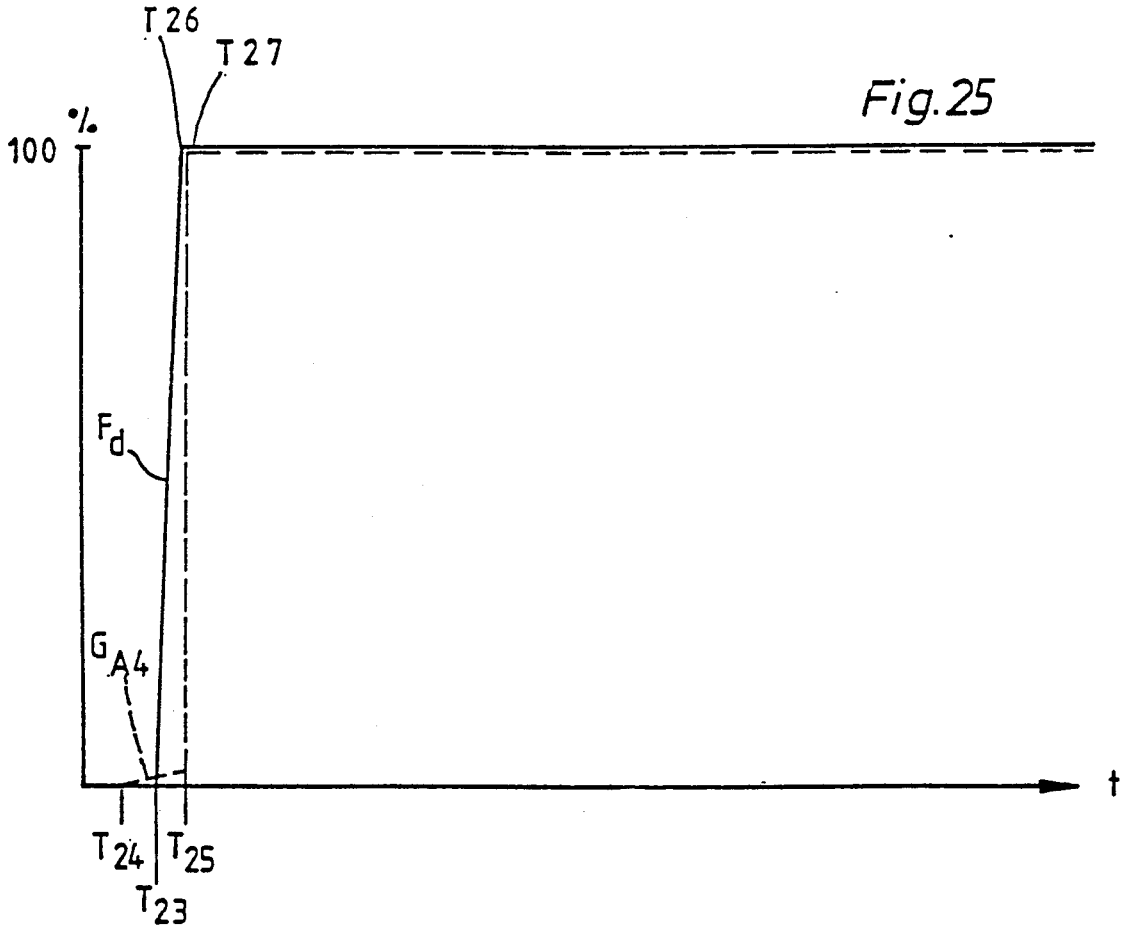
FIG. 25 is a diagram of a further variant of the process, according to the invention.

With such a rapid increase of the fiber flow it is no longer possible to achieve an adaptation of the yarn draw-off $G_A$ to fiber feeding F in the normal manner, through the acceleration of a draw-off device (see pair of draw-off rollers 13 in FIG. 4) and or a bobbin 122 (see FIG. 4). Instead of this, the yarn 20, upon completion of the first draw-off phase, is suddenly subjected to the clamping action of the driven pair of draw-off rollers 13 by which the yarn 20 is suddenly (between the points in time $t_{25}$ and $t_{27}$) brought to the draw-off speed effective during production (100%) (FIG. 25). An excess of yarn possibly produced thereby is compensated by the constitution of a yarn reserve or by greater acceleration of the bobbin 122.

The yarn 20 enters, for example, the nip of the pair of draw-off rollers 13 (in a known manner) during the yarn back-feeding $G_R$, whereby the draw-off roller 131 (the pressure roller of the pair of draw-off rollers 13 is at first lifted off the driven draw-off roller 130 and is again placed on said driven draw-off roller 130 at the desired point in time for the initiation of draw-off $G_{Aa}$ and thus causes the sudden draw-off acceleration.

Figure 26:
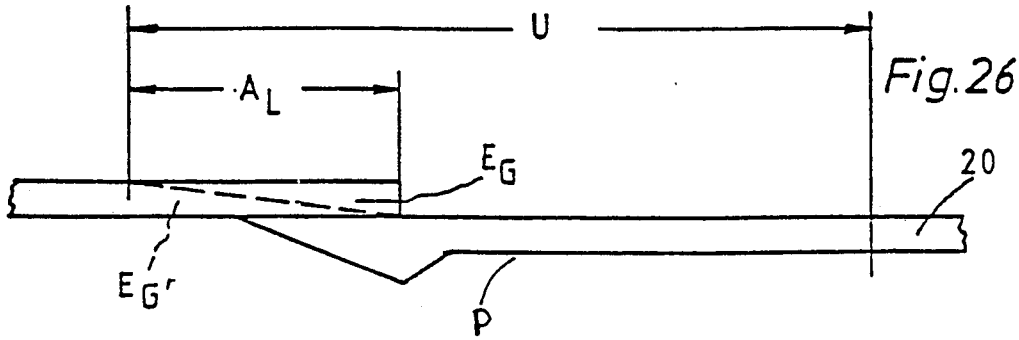
FIG. 26 is a view which schematically shows the yarn end, the fiber ring, and the beginning of the yarn in a process, according to FIG. 25.

As shown in FIG. 25, phase $G_{A4}$ of yarn draw-off can begin even before the deflection of the fiber stream is completed and fiber feeding $F_d$ to the fiber collection surface 10 has started (point in time $T_{23}$). Before yarn end $E_G$ leaves the fiber collection surface 160 the fibers 22 reach it, however, and the fiber feeding F now increases very rapidly. This rapid increase of the fiber feeding F (between the points in time $T_{23}$ and $T_{26}$) results in the piecing joint P to still have a sufficiently great mass of fibers in its length segment $A_L$ to ensure the required strength. As shown in FIG. 26, the piecing joint P is not only very short but even ends before the entire circumference U of the fiber collection surface 160 is spun into the new yarn.

With a somewhat longer stoppage time $t_{Sb}$ or $t_{Sc}$ (see FIG. 2) the run-up time $t_{Fb}$ or $t_{Fc}$ of the fiber feeding $F_b$ or $F_c$ is so slow that a controlled run-up of the yarn draw-off $G_{Ab}$ or $G_{Ac}$ can be adapted to the run-up of the fiber feeding $F_b$ or $F_c$. Yarn draw-off $G_{Ab}$ is, for example, effected by bobbin 122, being appropriately driven by means of the auxiliary drive roller 311 (FIG. 4).

The piecing joints P which are produced by means of one of the processes according to FIGS. 20 and 25, are characterized by the fact that they deviate relatively little from the desired measure of the completed yarn 20 and are relatively short, since yarn 20 reaches the predetermined desired thickness rapidly through coordination of the draw-off $G_A$ with the stoppage time of the feeding device 110 and, thereby, of the fiber sliver 2 (FIG. 26).

In principle, the overlap zone (length segment $A_L$) of the back-fed yarn end $E_G$ and the fibers newly fed on the fiber collection surface 160 is especially critical with respect to the incorporation and, thereby, also to the strength. For reasons of aspect the piecing joint is made as thin as possible in normal piecing joints P, as shall be explained in detail further on.

If care is taken that the piecing joint does not get on the new former in a bobbin replacement or is again drawn off from the former before the actual build-up of bobbin 122 has started and is then removed, the aspect of the piecing joint P need not be taken into consideration. In that case, it is useful to ensure only great strength of the piecing joint P. This is achieved in a variant of the process in that, the beginning and/or the acceleration of the draw-off $G_A$ for piecing in connection with a bobbin replacement, are set in the same way as for a long stoppage time $t_{Sc}$, i.e. as in case of severe depletion of the fiber tuft 21. Thus, a relatively thick piecing joint is created and is fed into a suction outlet 34 (FIG. 27), is cut from the yarn 20, which continues to be drawn off by the pair of draw-off rollers 13 from the open-end spinning element and is removed, whereupon the yarn 20 is transferred to the empty former to form a bobbin 122. The piecing joint P can, however, also go first to the old bobbin 122, again be unwound from the bobbin and conveyed to the suction outlet 34 (FIG. 27). In the latter case, the yarn 20 is then cut between piecing joint P and bobbin 122 and the piecing joint P is removed. The full bobbin 122 is then replaced in the winding device 12 by an empty former and (following the cutting of piecing joint P from the yarn being then fed) the yarn 20 then being fed is transferred to the newly inserted empty former.

To carry out this process, a bobbin replacement device with a monitoring device 33 to monitor the bobbin diameter is installed on the service unit 3 according to FIG. 4. This monitoring device 30 is connected for control via a circuit 305 to the control device 30 of the service unit 3.

If the service unit 3 passes a spinning station 10 whose bobbin 122 has attained the predetermined desired diameter, an appropriate command is transmitted by the monitoring device 33 to the control device 30 which then causes a yarn breakage and triggers the bobbin replacement and piecing of yarn 20. Since the yarn breakage has been triggered by the service unit 3 within the framework of its tasks in connection with bobbin replacement and piecing anew, the stoppage time $t_{Sa}$ of the feeding device 110 is rather brief. Nevertheless, the draw-off $G_A$ is controlled with respect to start and acceleration as it is for a long stoppage time $t_{Sc}$ and a thick piecing joint is created, however one of great strength.

To carry out the piecing process in connection with a bobbin replacement a special program can be stored in the control device 15, or one of the programs 150, 151, 152 . . . provided for the repair of yarn breakage is selected for piecing in connection with a bobbin replacement.

Instead of detecting the bobbin diameter from the service unit 3, it is also possible to assign a monitoring device 158 to the feeding roller 111 (FIG. 4, broken line) which is then connected to the control device 15 via a circuit 159 (also represented by a broken line). The feeding roller 111, which is made, as a rule, in the form of a shaft extending over a plurality of spinning stations 10, is provided with markings which are scanned (without contact) by the monitoring device 158 and signalled to the control device 15. Control device 15 is equipped with counters (not shown) which count the number of revolutions of the feeding roller 111 for each spinning station separately, taking into consideration possible interruptions (yarn breakage repairs) and deducts from this value the yarn length wound on bobbin 122. When the predetermined yarn length has been reached, the control device signals this to the service unit 3 so that the latter may carry out the above-described bobbin replacement upon its next arrival at the spinning station 10 concerned, proceeding (as mentioned) in piecing as if a long stoppage time $t_{Sc}$ had occurred.

For the sake of simplification it has been assumed in the preceding process that fixed programs 150, 151, and 152 are stored in the program memory of the control device 15. However, this is not required. The control device 15 can also be designed to develop its own program as a function of the stoppage time $t_{Sa}$, $t_{Sb}$, or $t_{Sc}$.

FIG. 27 shows an alternative embodiment of a device to carry out the described process. In a housing 161 of each spinning station 10, an open-end spinning device 11 is installed, of which FIG. 27 only shows the spinning element made in form of a spinning rotor 16, for the sake of simplification, while the feeding roller 111 and the opener device 116 (see FIG. 4) have been omitted. The spinning rotor 16 is driven via its shaft 162 selectively by means of a first drive belt 163 (during normal production) or by means of a second drive belt 164 (during the piecing phase). By means of a change-over device, which is indicated only schematically, the drive belt 163 or the drive belt 164 is selectively brought to bear against the shaft 162. In a third position the two drive belts are separated from the shaft 162, whereby shaft 162 can be subjected to the braking effect of a brake (not shown). The change-over device 17 is connected by means of a circuit 170 to the control device 15 and via this control device 15 and circuit 304 to the control device 30 for the control of the piecing process.

The device shown in FIG. 27 is, furthermore, equipped with two yarn accelerating devices 4 and 5, the first of these, yarn accelerating device 4 being constituted by the winding device 12 and a control device assigned to it and the second yarn accelerating device 5 by the pair of draw-off rollers 13 and a control device assigned to it.

The first yarn accelerating device 4 is constituted by the driving device capable of being controlled with a variable speed control and by the bobbin 122, by means of which the yarn 20 is at first gradually accelerated, and contains the controllable auxiliary drive roller 311 already mentioned in connection with FIG. 4. This auxiliary drive roller 311 is installed on a pivoting arm 321 and can be driven by means of a drive motor 312 via a drive connection 313, in the manner desired, once the auxiliary drive roller 311 has been brought to bear against the bobbin 122, a pivot drive 314 is being provided for this purpose.

The bobbin 122 must be lifted off from the winding roller 120 for bobbin 122 to be driven by the auxiliary drive roller 311. For this purpose pivot arms 32, to which a pivot drive 321 is assigned, are provided.

The second yarn accelerating device 5 is provided with a controllable pair of draw-off rollers 13. The latter is assigned a pivoted arm 50 as the control device which is able to work together with a pivoting lever 132, bearing the draw-off roller 131. For this purpose the pivoted arm is connected to a pivot drive 51 and to a lifting drive 52.

The drive motor 312, the pivot drive 314, the pivot drive 321, the pivot drive 51, as well as the lifting drive 52, are connected to the common control device 30, by which the different drives are switched on at the predetermined time and are driven at set or predetermined speeds. The pivot drive 51 and the lifting drive 52 are here connected, for control, via circuits 510 and 520 to the control device 30 which is provided with an adjusting device 6 with two adjusting elements 60 and 61 to control a time control device which is not shown here. The adjusting elements 60 control a time control device (not shown here) and serves to set the time for change-over from the gradual draw-off acceleration (Phase $G_A'$) to the sudden draw-off acceleration (phase $G_A''$ in FIG. 24) as a function of the desired yarn thickness, while the setting of this change-over moment is determined as a function of the diameter of the fiber collection surface 160, by means of the adjusting element 61.

Normally a plurality of identical open-end spinning devices 11 adjoin each other on one open-end spinning machine 1. To avoid that, the above-mentioned control and driving devices must be provided separately for each spinning station 10, these devices are installed according to FIG. 27 on the service unit 3 which is able to travel alongside the plurality of spinning stations 10. This service unit 3, in addition to other devices not shown here, furthermore, contains a suction outlet 34 as well as a yarn removing guide 35 over which the yarn 20 is first guided during piecing and which then releases it. For this purpose the yarn removing guide 35 is connected for control via circuit 306 to the control device 30.

To carry out piecing, the draw-off roller 131 is lifted off the draw-off roller 130 and the yarn 20 is drawn off in the normal manner from bobbin 122 which has already been lifted off the winding roller 120 at that point in time and is fed back to the spinning rotor 16. Yarn 20 is given a defined length and form in a known manner. By being fed back, the yarn 20 reaches the fiber collection surface 160 where it incorporates the fibers fed by the feeding device 110 (FIG. 4).

In synchronization with the switching on of the fiber feeding F, by means of the feeding device 110, the auxiliary drive roller 311 which has previously been brought to bear against bobbin 122 is driven in direction of draw-off. In accordance to a predetermined program stored in the control device 15 or 30, the auxiliary drive roller 311 and, thereby, also bobbin 122 are gradually accelerated. Yarn 20 is accordingly also accelerated gradually (phase $G_A'$) in order to maintain the yarn tension forces within the set tolerances.

After a predetermined time span the draw-off roller 131 (pressure roller) is brought to bear against the draw-off roller 130 and yarn 20 is thus clamped between these two draw-off rollers 130, 131 of the pair of draw-off rollers 13. This pair of draw-off rollers 13 thus takes over the continued draw-off of the yarn 20. Since the draw-off roller 130 is always driven at production speed, yarn 20 is suddenly accelerated to this production draw-off speed (100%). Simultaneously with the application of the draw-off roller 131 on the draw-off roller 130 the auxiliary drive roller 311 is also accelerated to production speed and the bobbin 122 is then brought to bear against the winding roller 120. If an excess of yarn is produced between the pair of draw-off rollers 13 and the winding device 12, it goes into intermediate storage in the suction outlet 34.

As mentioned earlier, the two-step acceleration (phases $G_A'$ and $G_A''$) of the draw-off speed of yarn 20 is intended to keep the deviation of the yarn 20 from its desired thickness as minimal as possible, on the one hand, and, on the other hand, to reduce the risk of yarn breakage. The first goal is achieved in that the acceleration of phase $G_A''$ is selected so that the velocity rate of draw-off $G_A$ may match the rate of the fiber feeding F as rapidly as possible or, in the case that the two velocity rates had already been equal, so that this synchronous relationship may be maintained. The second goal is achieved in that a relatively slow draw-off acceleration is selected in the overlapping zone of yarn end $E_G$ and fiber ring $R_F$, i.e. in the area of length segment $A_L$, whereby this phase $G_A'$ is also taken into consideration while taking into account the circumference U of the fiber collection surface 160. As has been mentioned initially, the yarn is under especially high tension in the intermediate zone $Z_G$ between the fiber collection surface 160 and the inlet opening into the yarn draw-off pipe 119 due to the centrifugal force exerting its action at that location and which is further increased by the high draw-off acceleration such as it was applied in the past. Due to the fact that the yarn is now subjected to gradual draw-off acceleration in phase $G_A'$, this tension is considerably reduced. The gradual draw-off acceleration must not be so great that insufficient twist reaches the yarn end $E_G$, but rather must be kept as low as possible. At the same time, care must be taken to avoid having the yarn receive excessive twist due to the rotation of the rotor during this time and being twisted off due to excessive twist. On the other hand, it is advantageous for the piecing joint P to have greater twist than the remainder of the yarn, as the same strength is thus achieved with a smaller piecing joint cross-section as otherwise only in larger cross-sections.

If the piecing point which is especially at risk of breakage, has reached the yarn draw-off pipe 119, the danger of yarn breakage is no longer so great. The moment of transition from phase $G_A'$ to $G_A''$ with greater draw-off acceleration must, therefore, be adapted to the diameter of the rotor.

This measure can easily be determined as it is in a certain relationship with the rotation of the auxiliary drive roller 311. The rotor diameter or the size of the fiber collection surface 160 is taken into account by means of the adjusting element 61.

As mentioned earlier, the change-over from phase $G_A'$ to phase $G_A''$ must be adapted not only to the size of the fiber collection surface 160 but also to the thickness of the yarn. The rotor diameter determines the earliest possible point in time for the change-over from phase $G_A'$ to $G_A''$ while the yarn number determines what kind of draw-off acceleration the yarn 20 is to be drawn off from the spinning element as of phase $G_A''$. This adjustment is effected by means of the adjusting elements 60 and 61. The time control device assigned to the adjusting elements 60 and 61 and which is not shown here is switched on by the entry into effect of the first phase $G_A'$ of the draw-off acceleration and, upon expiration of the preset time, causes the change-over to phase $G_A''$ of the draw-off acceleration.

The application of bobbin 122 on the winding roller 120 must also be coordinated with the transition from the first phase $G_A'$ to the second phase $G_A''$. For as long as the bobbin 122 is driven only by means of the auxiliary drive roller 311, the yarn 20 is wound up also only in the end zone of bobbin 122 in form of parallel windings which are later detrimental in further processing. For this reason the application of bobbin 122 on winding roller 120 is effected as early as possible in order to ensure that the yarn 20 is wound up as soon as possible in a changing manner.

As has been explained, the draw-off $G_A$ already begins at the point in time when fiber feeding F has been switched on but when the new fiber ring $R_F$ formed by fiber feeding F, has not yet attained its desired thickness which it normally requires for piecing. Yarn draw-off begins so gradually, however, and yarn 20 is at first drawn off from the fiber collection surface 160 with so little acceleration that the thickness of the fiber ring $R_F$ continues to increase even after the start of yarn draw-off. When the yarn end $E_G$ finally leaves the fiber collection surface 160 due to this yarn draw-off, the constantly growing fiber ring $R_F$ has not yet exceeded the desired thickness for draw-off. Draw-off acceleration is now increased rapidly until the speed of the yarn draw-off $G_A$ and the yarn feeding have reached the same percentage value of their respective production speed. It is the goal, in this case, that this may be achieved when a yarn length equal to the circumference U of the fiber collection surface 160 has been drawn off from the spinning rotor 16. As of this point of time, the speeds of the yarn draw-off $G_A$ and the fiber feeding F remain substantially synchronous, even if both have not yet reached their respective production speeds. This takes place in the manner described through adaptation of yarn draw-off $G_A$ to the combed-out state of the fiber tuft 21, since the run-up attitude of the fiber feeding F becoming effective on the fiber collection surface 160 depends on this combed-out state.

To ensure that yarn 20 may accept so little twist in the piecing phase that it may be drawn off from the spinning rotor 16 even at low speed, spinning rotor 16 is first brought by means of the change-over device 17 to a lower rotational speed $n'_R$, i.e. one which is lower than the production speed $n_R$ (FIG. 20) at which the spinning rotor 16 is driven by means of the drive belt 164. At this rotational speed $n'_R$ (below production speed $n_R$) the yarn 20 is fed back to the fiber collection surface 160 (see yarn $G_R$) and is combined there with the fibers which have been fed to it in the meantime. Yarn draw-off $G_A$ in phase $G_A'$, at gradually accelerated speed then takes place by means of bobbin 122 until yarn draw-off $G_A$ is accelerated more in phase $G_A''$ as a function of the previously mentioned factors. As a function of this transition from the first phase $G_A'$ to the second phase $G_A''$ the spinning rotor 16 is also accelerated once more in that the drive belt 164 is lifted off by means of the change-over device 17, the shaft 162 and drive belt 163 is brought to bear against the shaft instead, so that it may reach its production speed $n_R$ as near as possible substantially at the same moment when yarn 20 also reaches its production draw-off speed.

Just as in a process in which the spinning rotor 16 already rotates at full production speed $n_R$, piecing also is not carried out into the fast running spinning rotor 16 in the process described later, in which piecing is carried out at reduced rotor speed $n'_R$. This has the advantage that defined conditions prevail with respect to yarn twist.

Figure 29:
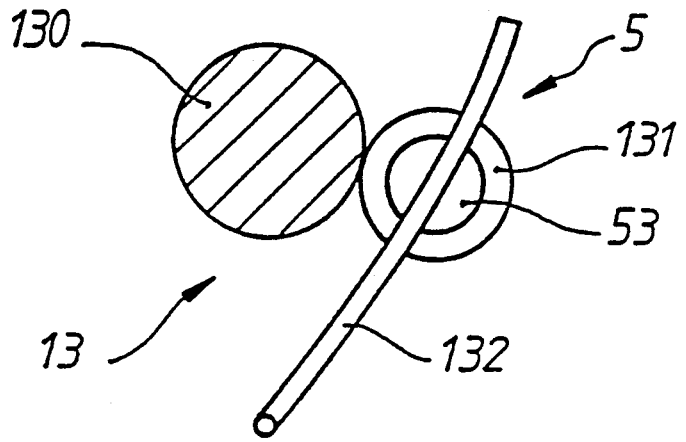
FIGS. 29 and 30 are views which show a pair of draw-off rollers in side-view, with two different control devices.

The multi-phase draw-off acceleration can also be achieved by means of the pair of draw-off rollers 13 itself, the draw-off attitude of which can be controlled in this case. FIG. 29 shows a draw-off roller 131 to which a controllable brake 53 is assigned. This brake 53 (e.g. an eddy current brake) is controlled in accordance with the desired acceleration attitude and brakes the draw-off roller 131 as needed so that yarn 20 is drawn off from the spinning element at a speed lower than the production draw-off speed. For the sake of simplification the corresponding control connections are not shown in FIG. 20.

Figure 30:
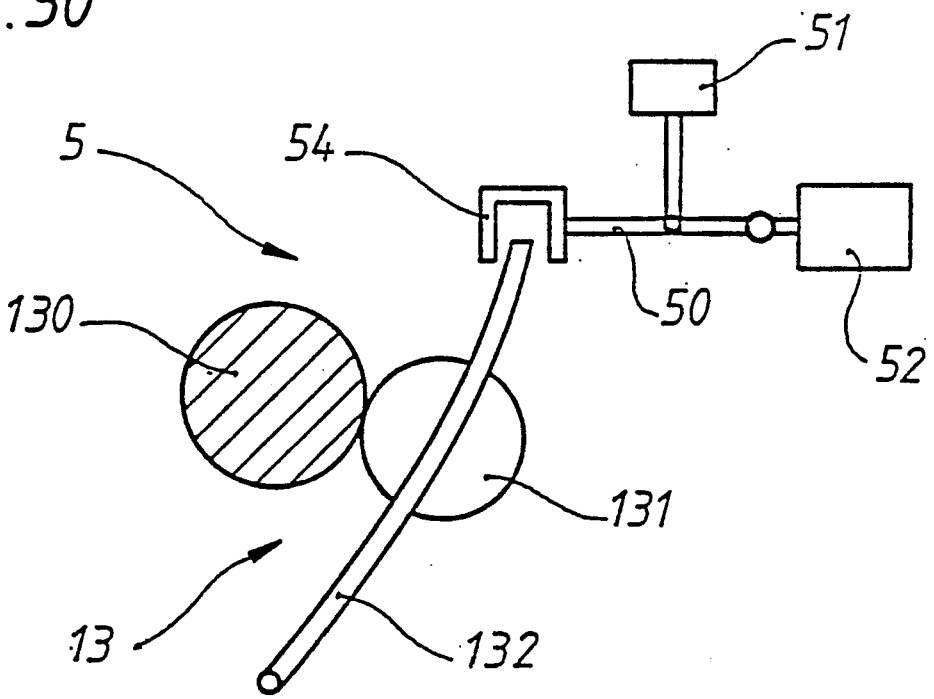

FIG. 30 shows an alternative embodiment in which the multi-phase draw-off acceleration is also controlled by means of the pair of draw-off rollers 13. The pivot arm 50 is here equipped with a fork 54 at its free end by means of which it is able to reach around the free end of the pivoted lever 132. The fork 54 brought into engagement with the free end of the pivoted lever 132, can be controlled continuously or in very small increments from the lifting drive 52 in such a manner that the distance between the two draw-off rollers 130 and 131 changes and the slippage between the draw-off rollers 130 and 131 can be influenced. In this manner, the draw-off force applied to yarn 20 is also controlled.

In the two embodiments shown in FIGS. 29 and 30, the draw-off attitude of the pair of draw-off rollers 13 is changed by the control device 30 and the production draw-off speed is transferred in a controlled manner to yarn 20 even though the draw-off roller 130 is always driven at production speed.

The device described can be varied in many ways by replacing different characteristics by equivalents or by using characteristics in combinations other than described. In a variant, a continuous drive shaft (not shown) is provided for the driven draw-off roller 130 which is driven by this continuous drive shaft via an instantaneous clutch, e.g. an induction coupling. The instantaneous clutch can be controlled as needed by the control device 30 of the service unit 3 so that the driving behavior and, thereby, the speed of the pair of draw-off rollers 13 may be influenced in the manner desired.

Figure 28:
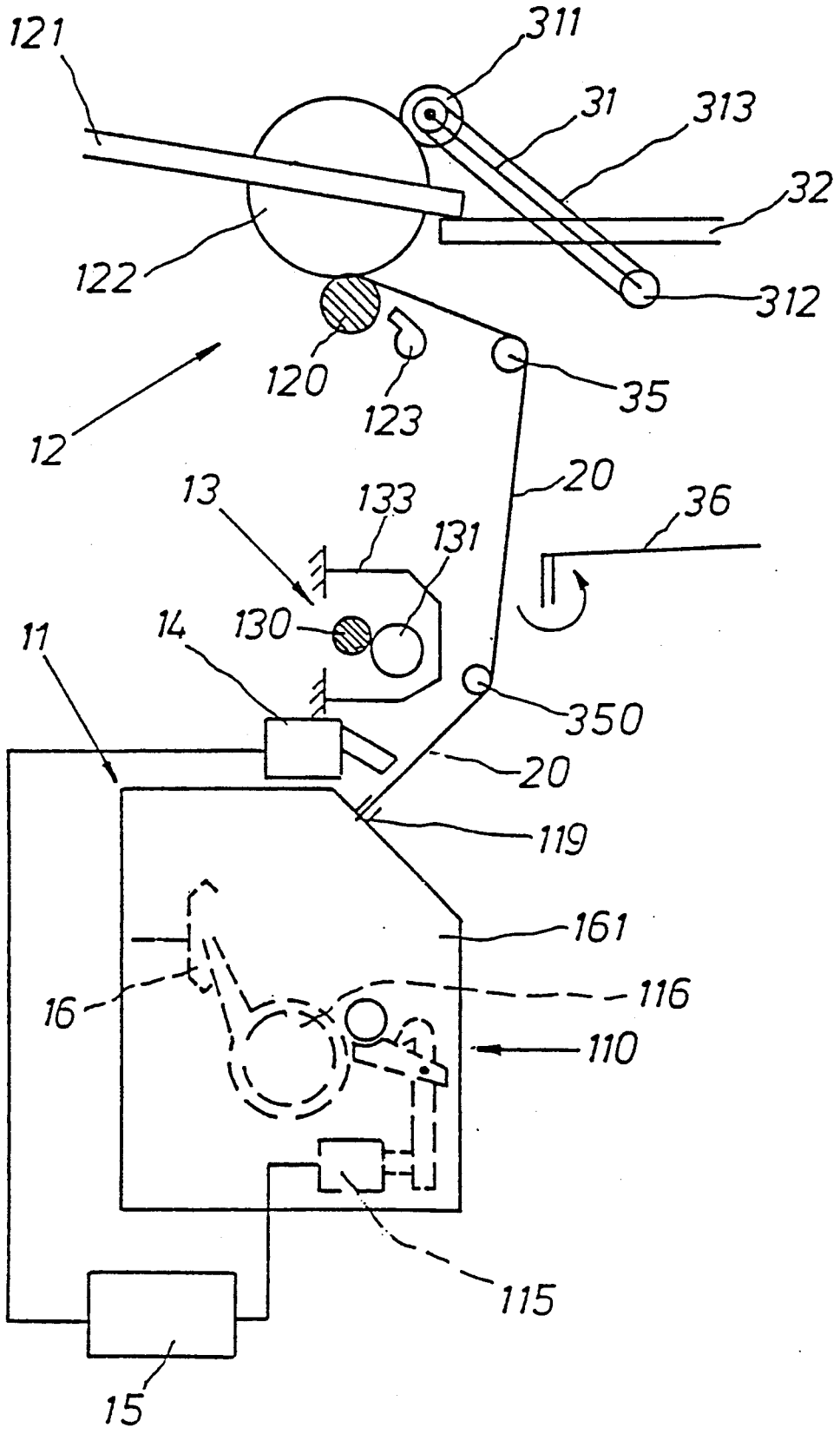
FIG. 28 is a schematic side view of part of the device, shown in FIG. 27, in a variant embodiment.

FIG. 28 shows another alternative embodiment. In this embodiment the two-phase draw-off acceleration is to be effected by means of bobbin 122 by driving the auxiliary drive roller 311 in accordance with the desired draw-off speed.

In the embodiment shown in FIG. 28, the yarn 20 is kept away from the pair of draw-off rollers 13 by two yarn bypass guides 35 and 350 until yarn 20 has been given its production draw-off speed by the winding device 12. During the draw-off acceleration, the draw-off roller 131 is applied on draw-off roller 130. For the insertion of yarn 20 into the nip of the pair of draw-off rollers 13, a pivoting yarn guide 36 is provided which is placed and movable in such manner that it brings yarn 20 to a stationary yarn guide 133, which then inserts yarn 20 into the nip of the pair of draw-off rollers 13. The yarn guide 36 and the stationary yarn guide 133 thus jointly constitute an inserting device for the insertion of the yarn 20 into the nip of the pair of draw-off rollers 13. This inserting device is connected for control (in a manner not shown here) to the control device 30 of service unit 3.

As has already been mentioned in connection with FIG. 33, every piecing joint $P_a$, $P_b$ or $P_c$ can be subdivided into different length segments $A_L$, $A_U$ or possibly $A_{Ga}$ or $A_{Gc}$. In order to obtain an unobtrusive yet good piecing joint $P_a$, $P_b$ or $P_c$ the yarn draw-off $G_A$ must be controlled differently in each of these length segments.

In order to obtain an unobtrusive length segment $A_L$ it must be avoided that wild windings W (see FIG. 6) are able to form. This is the case if the fiber ring is completely absent or is very small. This is achieved through the first phase with low draw-off acceleration.

The second length segment $A_U$ becomes thinner if fiber feeding F and fiber draw-off $G_A$ are brought, as quickly as possible, into a synchronous speed relationship, respectively referred to the respective production values in percentages. The second phase of the yarn draw-off must, therefore, be a phase of high draw-off acceleration, but only until yarn draw-off $G_A$ has reached the same percentage value of production speed as the fiber feeding.

The third length segment $A_{Ga}$ or $A_{Gc}$ has a thickness equal to that of the desired yarn size when fiber feeding F and yarn draw-off $G_A$ run synchronously. This can be already be the case during the run-up phase of the fiber feeding F and the yarn draw-off $G_A$. Production speed should be reached at the same time by the fiber feeding and the yarn draw-off $G_A$.

In the above-described embodiments the combined-out state of the fiber tuft 21 (FIG. 1), at the point in time of piecing, is ascertained by measuring the time from occurrence of a fiber breakage to the moment when fiber feeding is switched back on by releasing the fiber sliver. The values for the control device are determined by tests and measurements of the piecing joints. This determination is, thus, indirect.

Under another indirect method the fibers having reached the fiber collection surface before the beginning of the spinning process during stoppage periods of various lengths are counted and measured and from this the conclusions are drawn on the combed-out state of the fiber tuft 21. The values thus obtained are entered into the computer or control device 15 to determine the times and the accelerations.

The state of the fiber tuft 21 at a given moment can, however, also be ascertained directly. The fiber tuft 21 can, for example, extend through a light barrier, whereby the amount of light arriving into the photo diode give indications on the degree of depletion of the fiber tuft 21.

Figure 31:
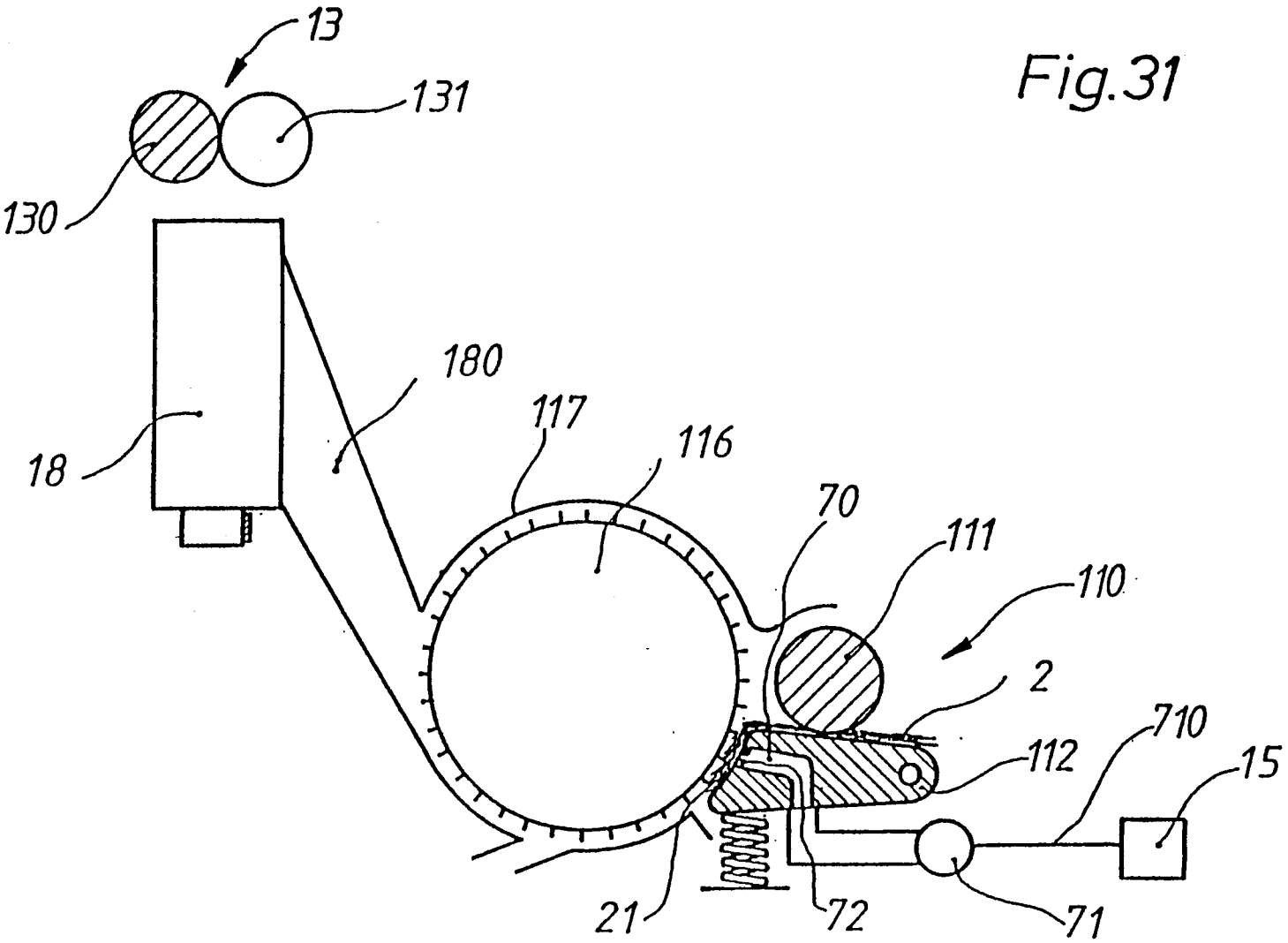
FIG. 31 is a schematic side view of a variant of an embodiment of an open-end spinning device, according to invention.

Another alternative for ascertaining the state of the fiber tuft directly is shown in FIG. 31. In this embodiment the scanning of the fiber tuft 21 (FIG. 1) is effected by measuring negative pressure. For it has been shown that, when a negative pressure is measured through the fiber tuft 21, the change in negative pressure is substantially proportional to the change in the combed-out state of the fiber tuft 21. For this purpose a negative pressure of a given force is produced on one side of the fiber tuft 21, i.e. in housing 117, and the drop in negative pressure is measured on the other side of the fiber tuft 21.

FIG. 31 shows a device to carry out such a process. As this drawing shows, an opening 70 to which a manometer 71 is connected, is located in the feeding tray 112. The opening 70 can be covered by a sieve 72 or similar device to prevent the end of fiber tuft 21 from entering the opening 70. It has, however, been shown that such a sieve 72 is generally dispensed with because if some of individual fibers of the fiber tuft 21 actually enter this opening 70 the negative pressure prevailing in the opener device 116 quickly causes the fiber tuft 21 to leave the opening 70.

If the fiber tuft 21 is not depleted or only slightly depleted the manometer 1 registers a correspondingly great negative pressure. The manometer 71 is connected via circuit 710 to the control device 15 where the control of the start and acceleration of yarn draw-off $G_A$ is determined as a function of the negative pressure values and, thereby, also as a function of the state of the fiber tuft 21, in every instance.

If the fiber tuft 21 has been depleted more severely, the negative pressure at the manometer 71 drops. This lower negative pressure is signalled to the control device 15 via circuit 710 so that the control device 15 is able to select the required program 150, 151, 156 etc.

(FIG. 4) for the yarn draw-off $G_A$ on basis of this signalled negative pressure.

If the fiber tuft 21 has been combed out heavily or even very heavily, the negative pressure at the manometer 71 drops to its lowest value or approaches it, whereupon the control device 15 selects the corresponding program 150, 152, 152 etc.

The measurement of the fiber tuft 21 can also be taken under production conditions so that changes in the negative pressure in relation to production conditions can be calculated easily.

The device according to FIG. 31 makes it possible to ascertain the actual combed-out state of the fiber tuft 21 at every spinning station. This state is, therefore, not averaged as in the embodiment according to FIG. 4, so that this device also detects variations from spinning station to spinning station with manometer 71 and takes them into consideration in determining the piecing program.

If the feeding device 110 is not equipped with a feeding tray, opening 70 can also be located at some other, appropriate location at the output of the feeding device 110.

As a comparison between FIGS. 28 and 31 shows, the process and the devices explained can be used with different types of open-end spinning elements. While a spinning rotor 16 with a ring-shaped fiber collection surface 160 is shown in FIG. 28 as the spinning element for example, two friction rollers 18 forming a nip to which the fibers are fed through a fiber feeding channel 180 are used as the spinning element in the embodiment shown in FIG. 31. In this case the fiber collection surface is constituted by the nip (not shown) between the friction rollers 18.

The different process and device variants have always been described above in connection with different fiber tufts resulting from different stoppage times $t_{Sa}$, $t_{Sb}$ and $t_{Sc}$. Different combed-out states of the fiber tufts occur not only with different stoppage times, however, but also with different materials, whereby not only the material but also the conditions of mixture, the fiber lengths and the treatment of the fibers play a role. Since not only the combed-out state of the fiber tuft but also the run-up behavior of the fiber stream varies with piecing in function with these factors, it is advantageous for these factors to be also taken into account as much as possible in the time periods stored in the programs.

It has been explained above that the start of fiber draw-off must be adapted to the state of the fiber tuft. It is understood that this process can also be applied if fiber feeding is briefly switched on after the yarn breakage for any reason, e.g. for intensive rotor cleaning, and in that case, the time span from the end of the last fiber feeding to the start of fiber feeding in connection with piecing counts as the stoppage time.

We claim:

1. A process for piecing a broken yarn on an open-end spinning device having a fiber collection surface, a fiber opening means, a sliver feeding means, and means for drawing-off spun yarn from said fiber collection surface and winding it onto a package, comprising the following steps:

(a) detecting a broken yarn on said open-end spinning device;

(b) stopping the feeding of fiber to said fiber collection surface by (c) restarting said sliver feeding and said fiber feeding;

(d) ascertaining the combed-out state of the fiber tuft of said sliver presented to said fiber opening means at the time of said restarting sliver feeding;

(e) restarting said yarn drawing-off; and (f) controlling the acceleration of said yarn drawing-off as a function of the ascertained combed-out state of said fiber tuft whereby the acceleration rate of said yarn drawing-off is varied according to the combed-out state of said fiber tuft to provide a piecing joint of a predetermined mass.

2. A process as set forth in claim 1, wherein said restarting said yarn drawing-off is commenced as a function of the ascertained combed-out state of said fiber tuft, whereby the time between said restarting said fiber feeding and said restarting said yarn drawing-off is varied as a function of the degree to which said fiber tuft has been depleted by said fiber opening means during stoppage of said open-end spinning device.

3. A process as set forth in claim 2 wherein said restarting said yarn drawing-off is commenced a predetermined time after restarting said fiber feeding which is longer in the case of a severe depletion of said fiber tuft than it is in the case of a lesser depletion of said tuft.

4. A process as set forth in claim 3, wherein said restarting said fiber feeding is commended after a predetermined time delay following when a broken yarn is detected and wherein the time period between said restarting said fiber feeding and restarting said yarn drawing-off is varied according to the ascertained combed-out state of the fiber tuft by changing the point in time when said yarn drawing-off is restarted in relation to the point in time when said fiber feeding is restarted.

5. A process as set forth in claim 2, wherein said restarting said yarn drawing-off is commenced within a predetermined time period following the detection of said broken yarn and the time period between said restarting said fiber feeding and restarting said yarn drawing-off is varied according to the ascertained combed out state of the fiber tuft by changing the point in time at which said fiber feeding is restarted in relation to the point in time when said yarn drawing-off begins.

6. A process as set forth in claim 1, wherein said step of ascertaining the combed out state of said fiber tuft comprises measuring the time that said sliver feeding is stopped after said yarn is broken, the stoppage time being indicative of the combed-out state of said fiber tuft.

7. A process as set forth in claim 1, wherein said step of ascertaining the combed out state of the fiber tuft comprises exerting a negative pressure of a predetermined force on one side of said fiber and measuring the negative pressure drop on the other side of said fiber tuft, the difference between the respective pressures being indicative of the combed-out sate of said fiber tuft.

8. A process as set forth in claim 1, wherein said controlling the acceleration of said yarn drawing-off comprises bringing said yarn drawing-off speed quickly to a production level after a predetermined short delay following the restarting of said fiber feeding in the case of a slight depletion of said fiber tuft, delaying the return of said yarn draw-off speed to a production level for a slightly longer predetermined delay where said tuft depletion is ascertained to be average, and extending said delay for a longer period where said tuft depletion is substantially complete so that the yarn draw-off reaches its full production speed substantially simultaneous with the fiber feed reaching its full production speed.

9. A process as set forth in claim 1, including the step of detecting when the yarn package reaches a full size, breaking the yarn before piecing begins and cutting the piecing joint out of the pieced yarn, and attaching the newly spun yarn to a replacement bobbin.

10. A process as set forth in claim 1, including the step of controlling the acceleration of said yarn draw-off so that said yarn draw-off and said fiber feeding are accelerated synchronously at a relatively equal percentage value of their production speeds up to said production speeds.

11. A process as set forth in claim 1, including the step of subjecting said yarn to the action of a controllable pair of draw-off rollers from the beginning of said yarn draw-off restarting.

12. A process as set forth in claim 11, including the step of driving one of said draw-off rollers continuously at full production daw-off speed and transferring said production draw-off speed to said yarn in a predetermined controlled degree by clamping said yarn between said pair of draw-off rollers.

13. A process as set forth in claim 12, including the step of transferring said production draw-off speed of said one roller to said yarn while permitting a controlled degree of slippage between said pair of draw-off rollers by controlling the distance between said draw-off rollers.

14. A process as set froth in claim 13, including the step of applying a brake in a controlled manner against a non-driven draw-off roller of said pair of draw-off rollers.

15. A process as set forth in claim 1, wherein said yarn drawing off means comprises a pair of draw-off rollers and winding means associated with said package and including the step of maintaining said yarn under tension between said draw-off rollers and said package.

16. A process as set forth in claim 15, including the step of stretching the yarn between said draw-off rollers and said package during said yarn draw-off acceleration.

17. A process as set forth in claim 16, including the step of reducing the slipping between said package and said winding means as said package is driven with increased acceleration.

18. A process as set froth in claim 16, including the step of subjecting said package to the action of two drives on opposite sides thereof while said package is driven with increased acceleration.

19. A process as set forth in claim 15, including the step of putting said yarn in intermediate storage between said pair of draw-off rollers and said package in order to stretch the yarn supplied by the pair of said during piecing.

20. A process as set froth in claim 1, including the steps of forming fibers fed on said fiber collection surface of a spinning rotor in the form a fiber ring and beginning said yarn drawing off before said fiber ring has completely formed, and drawing off said yarn in a first phase so that the thickness of said fiber ring increases to a desired thickness by the point in time when said backfed yarn end leaves the fiber collection surface, and subsequently increasing the rate of said yarn draw-off so that said yarn draw-off and said fiber feeding reach the same percentage value of their production values at the latest when a yarn length equal to the circumference of said spinning rotor has been drawn off from said fiber collection surface, and then maintaining a synchronous relationship between said yarn draw-off and said fiber feeding while accelerating to production speeds.

21. A process as set froth in claim 1, including the step of bringing said spinning rotor to a rotational speed below its production speed, feeding a yarn back to the fiber collection surface at said lower rotational speed and combining said backfed yarn end with fibers on said fiber collection surface, and subjecting said yarn to a multi-phase draw-off acceleration while said spinning rotor is accelerated to its production speed at the same time.

22. A process as set forth in claim 21, including the step of accelerating said spinning rotor from said rotational speed below said production speed to its full production speed in such a manner that it attains its production speed substantially at a point in time when said yarn reaches its production draw-off speed.

23. A process as set forth in claim 22, including the steps of drawing off said yarn in a multi-phased sequence.

24. A process as set forth in claim 1, including the step of shaping said back-fed yarn end to give an essentially wedged shaped configuration before said yarn end is fed back to said fiber collection surface.

25. A process for piecing a broken yarn on an open-end spinning frame device having a fiber collection surface, a fiber opening means, a sliver feeding means, and means for drawing-off spun yarn from said collection surface and for winding it onto a package, comprising the following steps;

(a) detecting a broken yarn on said open-end spinning device;

(b) stopping the feeding of fiber to said fiber collection surface by (c) backfeeding an end of a previously formed yarn to said fiber collection surface;

(e) restarting said sliver feeding and said fiber feeding;

(e) ascertaining the combed-out state of the fiber tuft of said sliver presented to said fiber opening means at the time of said restarting sliver feeding; and (f) restarting the yarn draw-off in a controlled multi-phase draw-off acceleration, said multi-phase acceleration including phases of varying rates of yarn draw-off dependent upon the ascertained combed-out state of said fiber tuft, the first phase of said multi-phase acceleration being coordinated with the incorporation of fibers into said backfed yarn end.

26. A process as set forth in claim 25, including the step of beginning to form a fiber ring in said fiber collection surface and starting the first phase of said yarn draw-off as the fiber flow increases and before said fiber ring forms completely.

27. A process as set forth in claim 25, including the step of terminating said first phase of said yarn draw-off when said backfed yarn end leaves said fiber collection surface.

28. A process as set forth in claim 25, including the step of adjusting the yarn draw-off acceleration in said first phase thereby modifying the degree of twist imparted to the pieced joint from the fiber collection surface, whereby the rate of yarn draw-off is slower when the propagation of the twist imparted to the pieced joint from said fiber collection surface is weaker so as to enhance propagation of the twist up to the point of incorporation of the fibers with the yarn end.

29. A process as set forth in claim 25, including the step of accelerating said yarn draw-off in an additional phase of said multi-phase yarn draw-off once a predetermined yarn mass has been obtained until said yarn draw-off and said fiber feed attain the same percentage values of their respective production values, whereby said yarn draw-off and said fiber feed are then accelerated synchronously to their respective production values.

30. A process as set forth in claim 25, including the step of accelerating said yarn draw-off relatively abruptly to a production speed in a second phase to avoid the formation of thick spots in the yarn.

31. A process as set forth in claim 30, including the step of drawing said yarn off by said package during said first phase of draw-off acceleration and by a pair of draw-off rollers driven at production draw-off speed in said additional phase of said yarn draw-off.

32. A process as set forth in claim 25, including commencing said restarting fiber feeding at generally the same time said previously formed yarn end is backfed to said fiber collection surface.

33. A process as set forth in claim 25, including commencing said backfeeding of a previously formed yarn end before said restarting said fiber feeding.

34. A process for piecing a broken yarn on an open-end spinning device having a fiber collection surface, a fiber opening means, a sliver feeding means, and means for drawing off spun yarn from said fiber collection surface and winding it onto a package, comprising the following steps:

(a) detecting a broken yarn on said open-end spinning device;

(b) stopping the feeding of silver to said fiber opening means;

(c) backfeeding an end of a previously formed yarn to said fiber collection surface;

(d) restarting said silver feeding and said fiber feeding;

(e) ascertaining the combed-out state of the fiber tuft of said silver presented to said fiber opening means at the time of said restarting silver feeding; and (f) restarting the yarn draw-off in a controlled multi-phase draw-off acceleration, said multi-phase acceleration including phases of varying rates of yarn draw-off dependent upon the ascertained combed-out state of said fiber tuft, the first phase of said multi-phase acceleration being coordinated with the incorporation of fibers into said backfed yarn end.

35. A process for piecing a broken yarn on an open-end spinning device having a fiber collection surface, a fiber opening means, a sliver feeding means, and means for drawing off spun yarn from said fiber collection surface and wining it onto a package, comprising the following steps;

(a) detecting a broken yarn on said open-end spinning device;

(b) stopping the feeding of fiber to said fiber collection surface by (c) backfeeding an end of a previously formed yarn to said fiber collection surface;

(d) restarting said sliver feeding and said fiber feeding;

(e) ascertaining the combed-out state of the fiber tuft of said sliver presented to said fiber opening means at the time of said restarting sliver feeding; and (f) restarting the yarn draw-off in a controlled multi-phase draw-off acceleration, said multi-phase acceleration including phases of varying rates of yarn draw-off dependent upon the ascertained combed-out state of said fiber tuft, the first phase of said multi-phase acceleration being coordinated with the incorporation of fibers into said backfed yarn end.

* * * * *